US005740493A

United States Patent [19]

Otaki et al.

[11] Patent Number: 5,740,493

[45] Date of Patent: Apr. 14, 1998

[54] ELECTROPHOTOGRAPHIC RECORDING APPARATUS HAVING REVERSE-CHARGED TONER REMOVING MEANS

[75] Inventors: Noboru Otaki; Kazuyoshi Yoshida; Yoshitatsu Okiyama; Masato Sakai; Hiroyuki Inoue; Syuichiro Ogata, all of Tokyo, Japan

[73] Assignee: Oki Data Corporation, Tokyo, Japan

[21] Appl. No.: 554,971

[22] Filed: Nov. 13, 1995

[30] Foreign Application Priority Data

Nov. 14, 1994 [JP] Japan ..... 6-278865
Jul. 28, 1995 [JP] Japan ..... 7-192984

[51] Int. Cl.[6] ..... G03G 21/00; G03G 15/00

[52] U.S. Cl. ..... 399/71; 399/55; 399/299

[58] Field of Search ..... 355/208, 271, 355/273, 274, 276, 296, 246, 219, 326 R, 327; 118/652; 430/125; 399/71, 314, 343, 344

[56] References Cited

U.S. PATENT DOCUMENTS

| | | | |
|---|---|---|---|
| 4,162,843 | 7/1979 | Inoue et al. | 355/327 |
| 4,413,899 | 11/1983 | Karasawa et al. | 355/326 R |
| 4,849,785 | 7/1989 | Tanabe | 355/326 R |
| 5,253,022 | 10/1993 | Takeuchi et al. | 355/274 |
| 5,298,956 | 3/1994 | Mammino et al. | 355/271 X |
| 5,404,213 | 4/1995 | Okano et al. | 355/246 X |
| 5,414,501 | 5/1995 | Miura et al. | 355/271 |
| 5,438,398 | 8/1995 | Tanigawa et al. | 355/271 |
| 5,450,170 | 9/1995 | Kimizuka et al. | 355/274 X |
| 5,453,822 | 9/1995 | Anzai et al. | 355/271 |
| 5,495,325 | 2/1996 | Nagahara | 355/246 X |
| 5,519,475 | 5/1996 | Miyamoto et al. | 355/271 |
| 5,557,384 | 9/1996 | Takano et al. | 355/274 |
| 5,606,408 | 2/1997 | Yano et al. | 399/343 |

FOREIGN PATENT DOCUMENTS 4-350879 12/1992 Japan .

*Primary Examiner*—Arthur T. Grimley
*Assistant Examiner*—Sophia S. Chen
*Attorney, Agent, or Firm*—Rabin, Champagne & Lynt, P.C.

[57] ABSTRACT

An electrophotographic recording apparatus that removes reverse-charged toner that is charged with a polarity opposite to a polarity of a normal-charged toner. The apparatus includes a carrier belt; a transfer roller for carrying the toner adhering to the surface of the photosensitive body toward the carrier belt; a transfer power supply for applying to the transfer roller a first voltage that causes the normal-charged toner adhering to the surface of the photosensitive body to be transferred to the recording medium on the carrier belt, and a second voltage, of opposite polarity to the first voltage, that causes the reverse-charged toner adhering to the surface of the photosensitive body to be transferred to the carrier belt; and a carrier belt cleaning blade. A control circuit controls an operation of the transfer power supply, whereby the first voltage is applied to the transfer roller during an image-forming stage, and the second voltage is applied to the transfer roller during a reverse-charged toner removing stage. For example, the normal-charged toner may have a negative polarity, the reverse-charged toner may have a positive polarity, the first voltage may be positive, and the second voltage may be negative.

34 Claims, 15 Drawing Sheets

NUMBER OF SHEETS PRINTED

ELECTROPHOTOGRAPHIC RECORDING APPARATUS HAVING REVERSE-CHARGED TONER REMOVING MEANS

BACKGROUND OF THE INVENTION

The present invention relates to an electrophotographic recording apparatus for causing charged toner to adhere to an electrostatic latent image on a surface of a photosensitive body (i.e., developing an electrostatic: latent image) and then transferring the developed toner image to a recording medium.

In an electrophotographic recording apparatus according to the prior art, the toner is frictionally charged in a developing unit and is then caused to adhere to an electrostatic latent image on a surface of a photosensitive body.

When toner is frictionally charged, particularly if it is a nonmagnetic single-component toner, the polarity of the charge is not the same for all the particles of toner. When, for example, negatively-charged toner (i.e., normal-charged toner) is used in the process of printing using the electrophotographic recording apparatus, there is a minute amount of toner that is charged with a positive polarity (hereinafter referred to as reverse-charged toner) rather than a negative polarity. When such reverse-charged toner is present, the reverse-charged toner (which is mixed with the negatively-charged toner) adhering to the surface of the photosensitive body during the developing process, is not transferred to the recording medium in the transferring process. This produces a considerable residue on the surface of the photosensitive body, thereby adversely affecting subsequent charging, exposure and developing processes. This leads "fogging" of the photosensitive body, and results in the degradation of the print quality.

SUMMARY OF THE INVENTION

The object of the present invention is to provide a electrophotographic recording apparatus which can remove the reverse-charged toner, resulting in improved printing quality.

According to an aspect of the present invention, the electrophotographic recording apparatus comprises: a photosensitive body; a charger for imparting a charge uniformly to a surface of the photosensitive body; a first power supply of the charger for applying a voltage to the charger; a writing unit for forming an electrostatic latent image on the uniformly charged surface of the photosensitive body; a developing unit for causing toner including the normal-charged toner and the reverse-charged toner to adhere to the surface of the photosensitive body bearing the electrostatic latent image; a carrier belt for transporting a recording medium; a transfer unit for carrying the toner adhering to the surface of the photosensitive body toward the carrier belt; a second power supply of the transfer unit for applying to the transfer unit a first voltage for an image-forming that causes the normal-charged toner adhering to the surface of the photosensitive body to be transferred to the recording medium on the carrier belt, and a second voltage for a reverse-charged toner removing, of opposite polarity to the First voltage, that causes the reverse-charged toner adhering to the surface of the photosensitive body to be transferred to the carrier belt; a carrier belt cleaner for removing the reverse-charged toner adhering to the carrier belt; and a controller for controlling an operation of the second power supply so that the second power supply applies the first voltage to the transfer unit at the image-forming, and the second power supply applies the second voltage to the transfer unit at the reverse-charged toner removing. For example, the normal-charged toner has a negative polarity, the reverse-charged toner has a positive polarity, the first voltage is positive, and the second voltage is negative.

In another aspect of the present invention, the first power supply of the charger applies to the charger a third voltage for the image-forming that causes the surface of the photosensitive body to be charged uniformly, and a fourth voltage for the reverse-charged toner removing, of opposite polarity to the third voltage, that causes the reverse-charged toner adhering to the surface of the charger to be transferred to the surface of the photosensitive body. For example, the normal-charged toner has a negative polarity, the reverse-charged toner has a positive polarity, the third voltage is negative, and the fourth voltage is positive.

In another aspect of the present invention, the developing unit comprises a developing tank for containing the toner, and a developing roller for supplying the toner to the surface of the photosensitive body. The electrophotographic recording apparatus further comprises a third power supply of the developing roller for applying to the developing roller a fifth voltage for the image-forming that causes the normal-charged toner adhering to the surface of the developing roller to be transferred to the surface of the photosensitive body, and a sixth voltage for the reverse-charged toner removing, of opposite polarity to the fifth voltage, that causes the reverse-charged toner adhering to the surface of the photosensitive body not to be transferred to the developing roller. For example, the normal-charged toner has a negative polarity, the reverse-charged toner has a positive polarity, the fifth voltage is negative, and the sixth voltage is positive.

In still another aspect of the present invention, the electrophotographic recording apparatus further comprises: a cleaning roller for temporarily capturing the reverse-charged toner adhering to the surface of the photosensitive body; and a fourth power supply of the cleaning roller for applying to the cleaning roller a seventh voltage that causes the reverse-charged toner adhering to the surface of the photosensitive body to be transferred to a surface of the cleaning roller, and an eighth voltage, of opposite polarity to the seventh voltage, that causes the reverse-charged toner adhering to the surface of the cleaning roller to be transferred to the surface of the photosensitive body. For example, the normal-charged toner has a negative polarity, the reverse-charged toner has a positive polarity, the seventh voltage is negative, and the eighth voltage is positive.

DETAILED DESCRIPTION OF THE INVENTION

Figure 1:
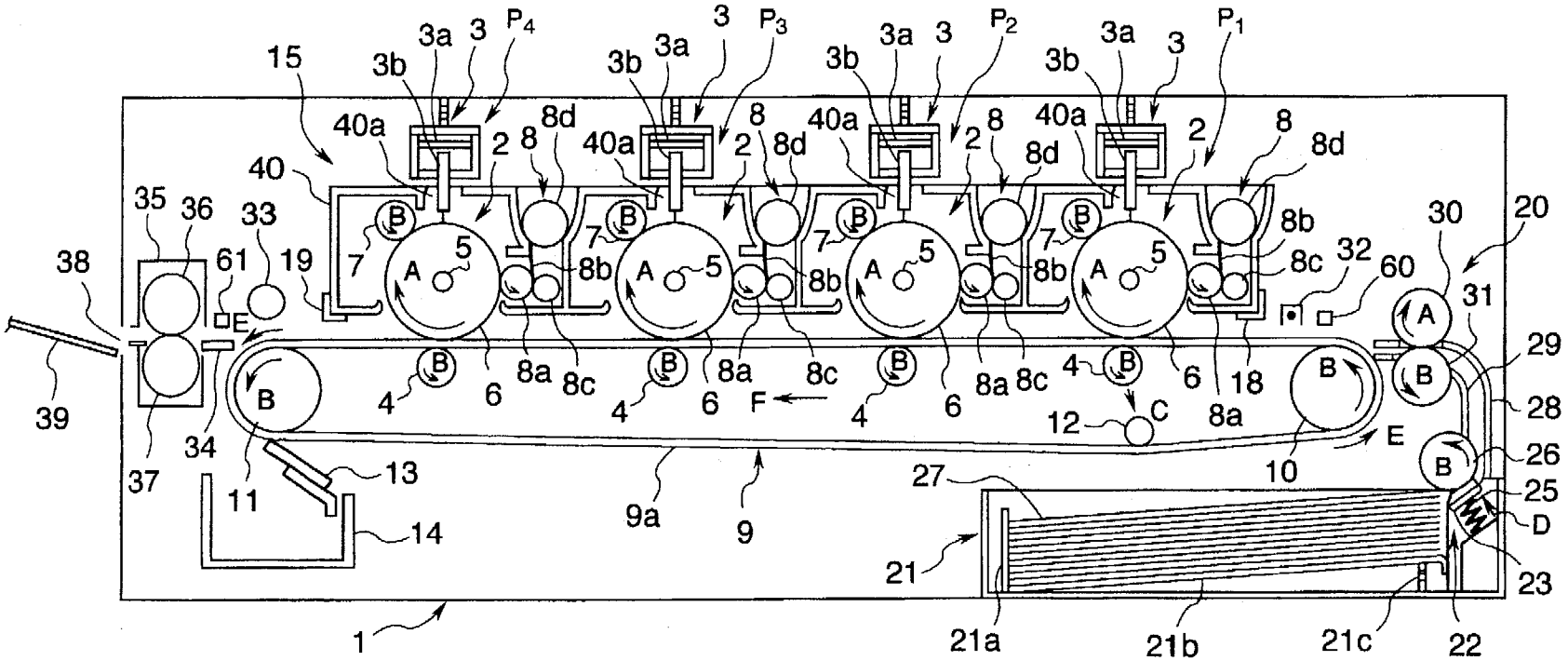
FIG. 1 is a structural schematic diagram showing an electrophotographic recording apparatus according to a first embodiment of the present invention.

The following is an explanation of the preferred embodiments of the present invention with reference to the drawings. Common elements in the drawings are assigned identical reference numerals.

FIRST EMBODIMENT

Figure 2:
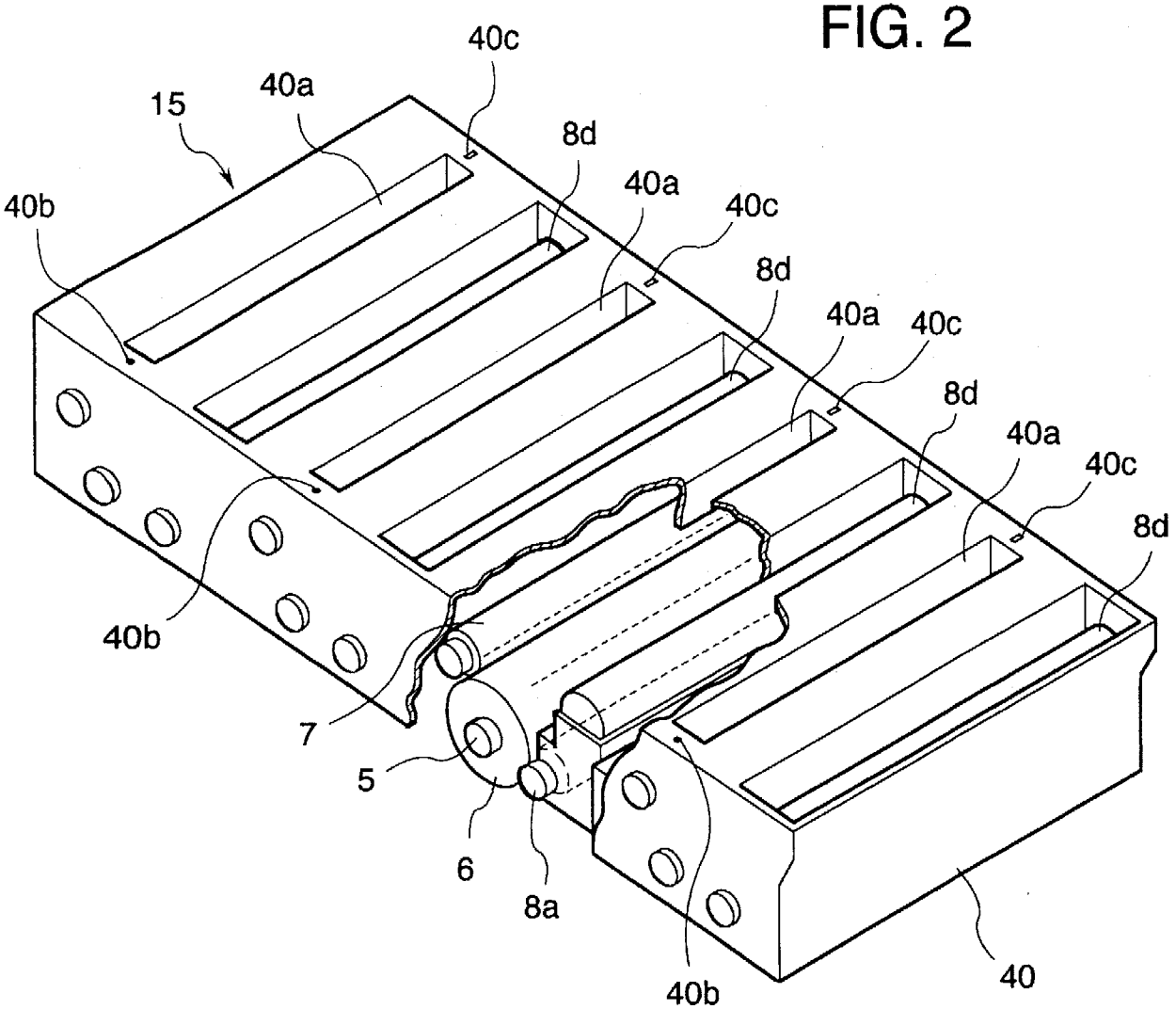
FIG. 2 is a perspective view showing an image-forming unit of the electrophotographic recording apparatus according to the first embodiment.

FIG. 1 is a structural schematic diagram showing an electrophotographic recording apparatus according to the first embodiment of the present invention. FIG. 2 is a perspective view showing an image-forming unit 15 incorporated within the electrophotographic recording apparatus of the first embodiment.

In FIG. 1, the electrophotographic recording apparatus 1 is a color image recording apparatus, in which four printing mechanisms $P_1$, $P_2$, $P_3$ and $P_4$ for the printing of four different colors are arranged in order from the side for the insertion of a recording medium 27 to the side for its ejection (from the right to the left of FIG. 1). The printing mechanisms $P_1$–$P_4$ print, respectively, the colors yellow, magenta, cyan and black. All of the printing mechanisms $P_1$ through $P_4$ are electrophotographic light-emitting diode (LED) printing mechanisms, and all are of identical structure. The printing mechanism $P_1$ comprises an image-forming section 2, an LED head 3 which exposes a photosensitive body or drum 6 in accordance with image data, and a transfer roller 4 which transfers the toner image formed by the image-forming section 2 to the recording medium 27.

The image-forming section 2 comprises the photosensitive body 6 in the form of a drum which rotates around an axis 5 in direction A (the clockwise direction in FIG. 1), a charging roller 7 which imparts a uniform charge to a surface of the photosensitive body 6, and a developing unit 8 which contains a nonmagnetic single-component toner. The developing unit 8 comprises a developing roller 8*a* which is made of a semiconductive rubber material, a developing blade 8*b* which is in contact with the developing roller 8*a* at a constant pressure, a sponge roller 8*c* which supplies a suitable amount of toner to the developing roller 8*a*, and a toner tank 8*d*. A bias voltage is applied between the developing roller 8*a* and the sponge roller 8*c* to facilitate the movement of charged toner from the sponge roller 8*c* to the developing roller 8*a*. The toner supplied from the toner tank 8*d* passes the sponge roller 8*c* to reach the developing blade 8*b*. The toner is spread evenly in a thin layer on the outer surface of the developing roller 8*a* by the rotation of the developing roller 8*a*, before reaching the contact surface of the photosensitive body 6. The toner is frictional charged when it is vigorously rubbed by the developing roller 8*a* and the developing blade 8*b* during formation of the thin layer. In the first embodiment, the frictional charge is of negative polarity. Note that when the toner is exhausted, a new supply off toner can be obtained by replacing the toner tank 8*d*.

The LED head 3 comprises an LED array (not shown in the figures), a printed circuit board 3*a* on which are mounted driver ICs for driving the LED array, and a SELFOC Lens array 3*b* for condensing the light from the LED array. The LED head 3 causes the IED array to emit light in response to an image data signal input from the interface, which will be described below, exposing the surface of the photosensitive body 6 and forming an electrostatic latent image. The toner that adhered to the outer surface of the developing roller 8*a* adheres to the electrostatic latent image due to electrostatic force, and a toner image is formed. A movable carrier belt 9, which will be described in detail below, is disposed between the photosensitive body 6 and the transfer roller 4.

The toner contained in the developing unit 8 of the printing mechanism $P_1$ is yellow (y). The toner in the developing unit 8 of the printing mechanism $P_2$ is magenta (M). The toner in the developing unit 8 of the printing mechanism $P_3$ is cyan (C), and the toner in the developing unit 8 of the printing mechanism $P_4$ is black (B). Further, the color image signal input to the LED head 3 of the printing mechanism $P_1$ is the yellow image signal, the color image signal input to the LED head 3 of the printing mechanism $P_2$ is the magenta image signal, the color image signal input to the LED head 3 of the printing mechanism P3 is the cyan image signal, and the color image signal input to the LED head 3 of the printing mechanism $P_4$ is the black image signal.

Further, as shown in FIG. 2, the image-forming sections 2 of the printing mechanisms $P_1$ through $P_4$ are mounted to a case 40, to form the color image-forming unit 15. The color image-Forming unit 15 is held in position within the electrophotographic recording apparatus 1 by means of guides 18 and 19, as shown in FIG. 1. Further, the color image-forming unit 15 can be removed from the electrophotographic recording apparatus 1. The case 40 of the color image-forming unit 15 is provided with window holes 40*a* and guide pins 40*b* and 40*c* for the LED heads 3, whereby it is possible to position the LED heads 3 with respect to the color image-forming unit 15.

The carrier belt 9 is an endless, seamless belt made from semiconducting plastic film having a high-resistance, and runs over a driver roller 10, a follower roller 11 and a tension roller 12. The value of the surface resistance of the carrier belt 9 is in a range such that while the recording medium 27 is being transported, static adhesion of the recording medium 27 to the carrier belt 9 is attained. Morever, when the recording medium 27 is separated from the carrier belt 9, the residual electrostatic force in the carrier belt 9 is discharged naturally. Judging by the results of experiments, it is desirable that the value of the surface resistance be $10^{10}$ ohms through $10^{14}$ ohms. The driver roller 10 is connected to a motor, which will be described below, by which it is rotated in direction B (the counterclockwise direction in FIG. 1) and the carrier belt 9 is moved in direction E. The tension roller 12 is urged in direction C by a spring (not shown in FIG. 1), thereby maintaining tension on the carrier belt 9. A cleaning blade 13 is forced against the follower roller 11 across the carrier belt 9.

The cleaning blade 13 is made from a flexible material such as rubber, plastic or the like. The leading edge of the cleaning blade lid is forced against the carrier belt 9, removing the toner adhering to the surface 9*a* of the carrier belt 9, and causing the toner to fall into a waste toner tank 14. Note that in the first embodiment, both the photosensitive body 6 and the transfer roller 4 are in contact with the carrier belt 9.

The electrophotographic recording apparatus 1 is also provided with a paper Feed mechanism 20 which comprises a cassette 21 containing stacked sheets of recording medium 27, a hopping mechanism 22 which feeds out the recording medium 27 one sheet at a time, and resist rollers 30 and 31 which deliver the recording medium 27 to the carrier belt 9. The cassette 21 comprises a recording medium storage box 21*a* which accommodates the recording medium 27, an upward-pressing plate 21*b*, and a spring 21*c* which acts as an upward-pressing member that presses upward on the upward-pressing plate 21*b*. A hopping mechanism 22 comprises a discriminator member 23 which extracts the recording medium 27 one sheet at a time, a spring 25 which urges the discriminator member 23 in direction D, and a paper feed roller 26 which is forced against the discriminator member 23. The recording medium 27, which is fed out by the hopping mechanism 22, is guided by guides 28 and 29 so that it reaches paired resist rollers 30 and 31.

A charger 32 and a photointerrupter 60 are provided between the printing mechanism $P_1$ and the resist rollers 30, 31, and opposite to the surface 9*a* of the carrier belt 9. The charger 32 imparts a charge to the recording medium 27 delivered by the paper feed mechanism 20, and causes the recording medium 27 to adhere electrostatically to the surface 9*a* off the carrier belt 9. The first embodiment is not limited to the charger 32, and it is equally possible to provide, instead of the charger 32, a pair of rollers between which the carrier belt 9 moves, and between which the recording medium 27 is delivered while a voltage is applied to the rollers causing static adhesion. The photointerrupter 60 detects the leading edge of the recording medium 27 delivered by the paper feed mechanism 20, and outputs the detected result to the control circuit, which will be described below.

Further, a discharger 33, disposed opposite to the surface 9*a* of the carrier belt 9 at the side off the follower roller 11, is attracted to the carrier belt 9 to discharge the recording medium 27 that is being transported, and can easily be separated from the carrier belt 9 by releasing the adhesion state. There is further provided, downstream in the direction F in which the recording medium is carried from the discharger 33, a guide 34 which guides the recording medium 27 to the fixing unit (which will be described below), and a photointerrupter 61, which detects the trailing edge of the recording medium 27 as it passes through the guide 34.

A fixing unit 35 is located in the direction of ejection from the guide 34, which heats the toner image that was transferred to the recording medium 27 and fixes it to the medium 27. The fixing unit 35 comprises a heat roller 36 which heats the toner on the recording medium 27, and a presser roller 37 which, together with the heat roller 36, exerts pressure on the recording medium 27. An ejection port 38 and an ejection stacker 39 are located in the direction of ejection from the fixing unit 35. The printed recording medium 27 is ejected From the ejection port 38 to the ejection stacker 39.

Figure 3:
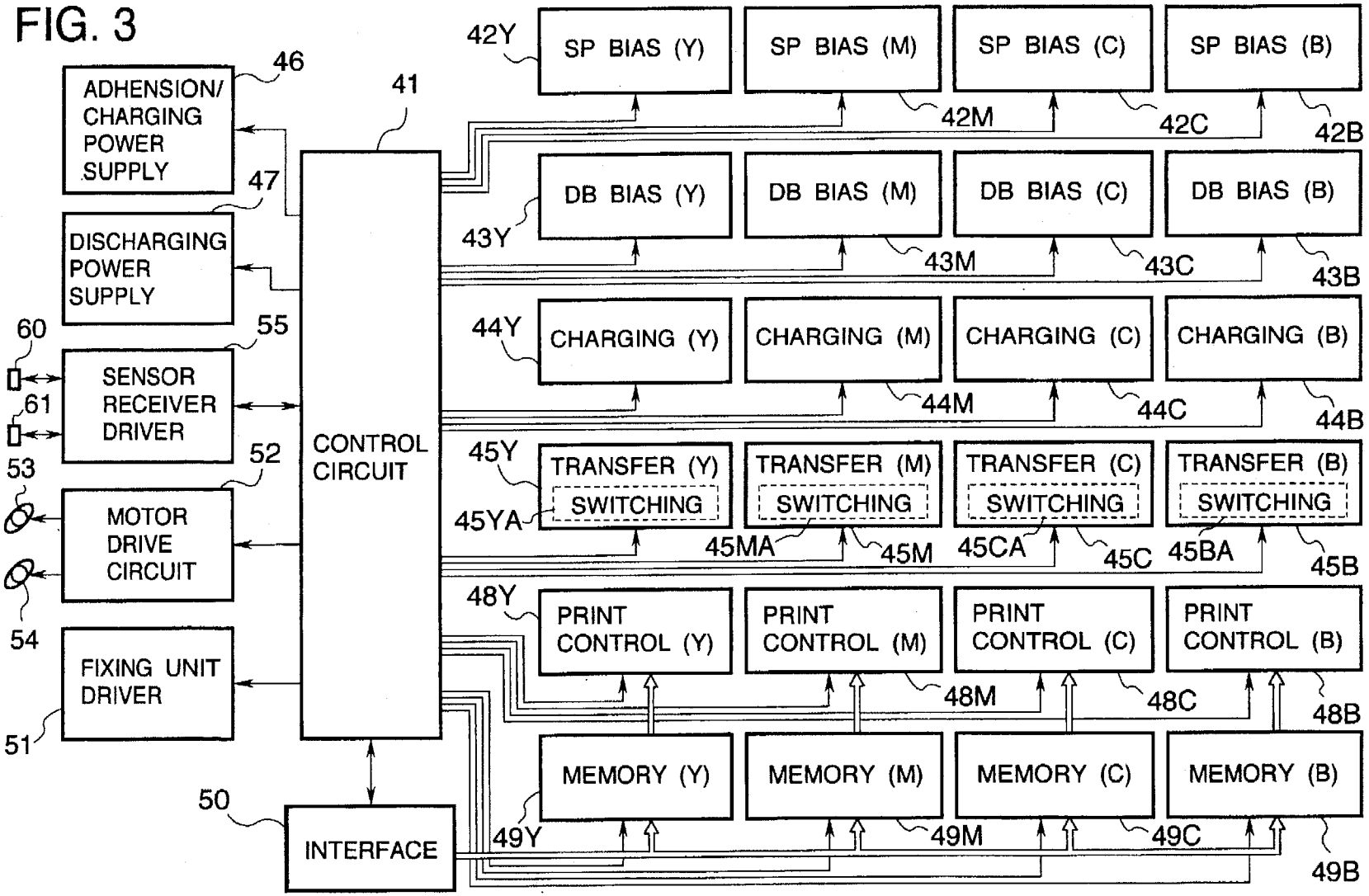
FIG. 3 is a block diagram showing a control system of the electrophotographic recording apparatus according to the first embodiment.

The following is an explanation of the control system according to the first embodiment, with reference to FIG. 3, which is a block diagram showing the control system. Note that in the figures the letters Y, M, C and B denote the colors yellow, magenta, cyan and black, respectively, and correspond, respectively, to printing mechanisms $P_1$, $P_2$, $P_3$ and $P_4$.

The control circuit 41 comprises a microprocessor and other components, and controls all operations of the electrophotographic recording apparatus 1. SP bias power supplies 42Y, 42M, 42C and 42B are connected to the control circuit 41 and supply power to the sponge rollers 8C. DB bias power supplies 43Y, 43M, 43C and 43B are connected to control circuit 41, and supply power to the developing rollers 8*a*. Charging power supplies 44Y, 44M, 44C and 44B are connected to control circuit 41, and supply power to the charging rollers 7. Transfer power supplies 45Y, 45M, 45C and 45B are connected to control circuit 41, and supply power to the transfer rollers 4, which are provided in each of the developing units 8 of the printing mechanisms $P_1$ through $P_4$. Each of the transfer power supplies 45Y, 45M, 45C and 45B has a polarity-switching circuit 45YA, 45MA, 45CA and 45BA, which is connected to the control circuit 41, allowing the polarity of the transfer voltage applied to each transfer roller 4 to be switched between negative and positive.

An adhesion/charging power supply 46 is connected to the control circuit 41 which supplies charging power to the charger 32. A discharging power supply 47 is likewise connected to control circuit 41, which supplies high-voltage power to the discharger 33 for discharging.

All the power supplies referred to above are driven and controlled by the control circuit 41.

Print control circuits 48Y, 48M, 48C and 48B, are additionally connected to control circuit 41, and correspond to the printing mechanisms P1 through $P_4$, respectively. The print control circuits 48Y, 48M, 48C and 48B receive image data from memories 49Y, 49M, 49C and 49B, respectively, and, in accordance with instructions from the control circuit 41, send the image data to their respective LED heads 3, control ling the emitting time of the LED head 3 and controlling the formation of electrostatic; latent images on the surface of the photosensitive body 6. The memories 49Y, 49M, 49C and 49B store image data that has been sent from an external device, such as a host computer, via the interface 50. The interface 50 separates the image data sent from the external device by color: yellow image data is stored in the memory 49Y, magenta image data in the memory 49M, cyan image data in the memory 49C, and black image data in the memory 49B.

A fixing unit driver 51, a motor drive circuit 52 and a sensor receiver driver 55 are also connected to control circuit 41. In order to keep the heat roller 86 of the fixing unit 85 at a constant temperature, the fixing unit driver 51 drives a heater (not shown in the figures) within the heat roller 36. The motor drive circuit 52 drives the motor 54, as well as the motor 53 which rotates the paper feed roller 26. The motor 54 drives the resist rollers 30 and 31, the photosensitive bodies 6, the charging rollers 7, the developing rollers 8*a*, the sponge rollers 8*c* and the transfer rollers 4 of the printing mechanisms $P_1$ through $P_4$ as well as the driver roller 10, and the heat roller 36. The rollers that are driven by the motor 54 are connected thereto by gears or belts (not shown in the figures). The sensor receiver driver 55 drives the photointerrupters 60 and 61, and receives the output waveforms of the photointerrupters 60 and 61, sending them to the control circuit 41.

The following is an explanation of the printing operation using the electrophotographic recording apparatus 1.

First, when the power supply of the electrophotographic recording apparatus 1 is turned on by a switch (not shown in the figures), the control circuit 41 carries out a specified initial set-up, after which it drives the fixing unit driver 51 so that the heat roller 36 of the fixing unit 35 warms up to the specified temperature. The control circuit 41 controls the temperature of the heat roller 36 so that it remains constant. When the heat roller 36 reaches the specified temperature, the control circuit 41 then drives the motor 54 for a specified period of time by means of the motor drive circuit 52, causing the driver roller 10 to rotate and the carrier belt 9 to move in direction E. The carrier belt 9 stops a little after it has been carried full circle. In this way any contamination, such as reverse-charged toner or the like that may be adhering to the surface 9*a* of the carrier belt 9 from the previous printing operation is removed using the cleaning blade 13 and allowed to fall into a waste toner tank 14.

With this, the initial set-up of the electrophotographic recording apparatus 1 is complete, and the control circuit 41 waits for image data Lo be sent to it from the external device via the interface 50.

When the control circuit 41 receives image data from the external device, that is to say the host computer, via the interface 50, it outputs instructions to the interface 50 and to the memories 49Y, 49M, 49C and 49B. On the basis of these instructions, the interface 50 separates the image data by color and stores the color-separated image data in the color-separated memories 49Y, 49M, 49C and 49B. That is to say, yellow image data is stored in the memory 49Y, magenta image data in the memory 49M, cyan image data in the memory 49C, and black image data in the memory 49B. In this way the image data of each color that is to be printed on one sheet of the recording medium 27 is stored in the memories 49Y, 49M, 49C and 49B.

Figure 4:
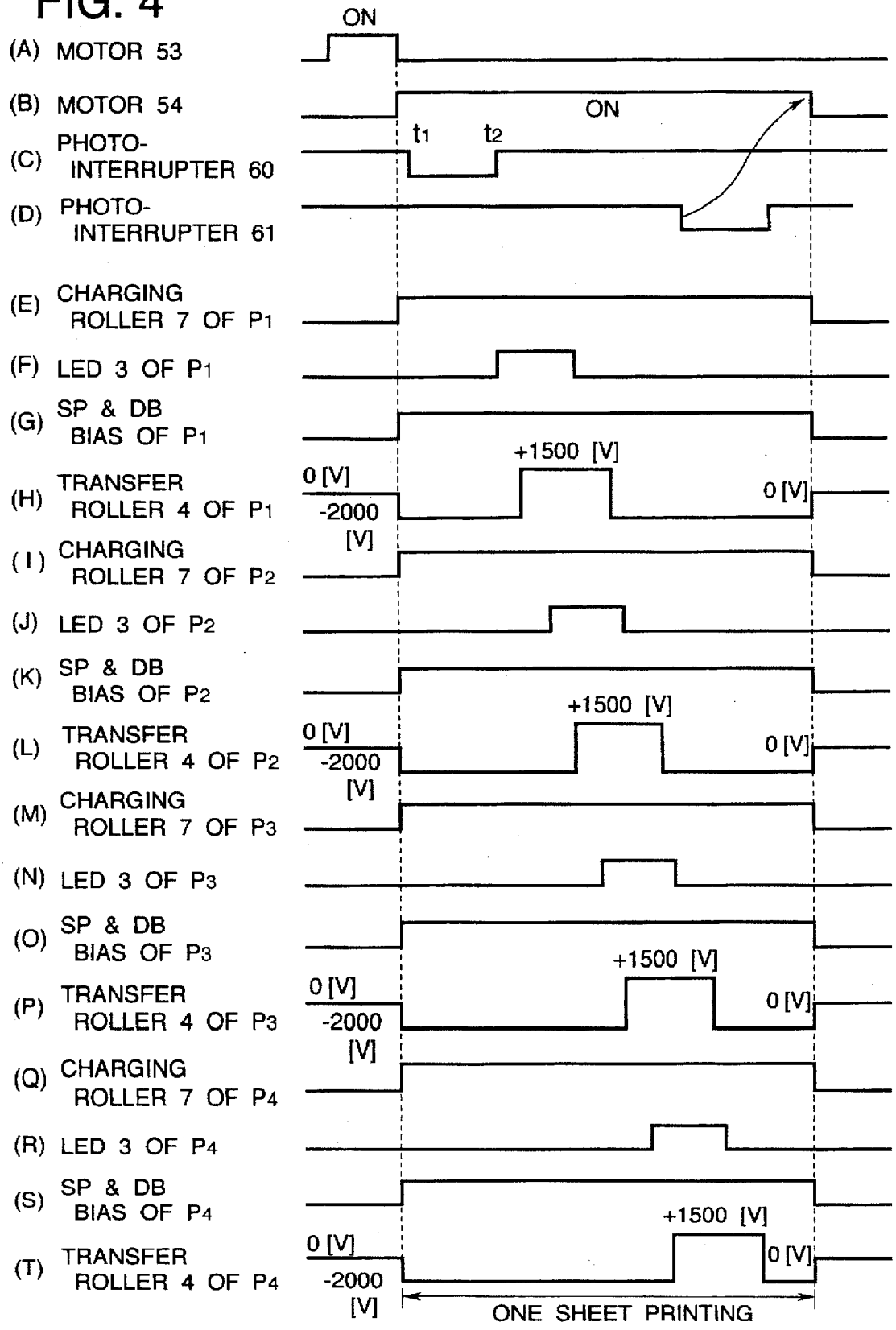
FIG. 4 is a timing chart showing the printing operation of the electrophotographic apparatus according to the first embodiment.
Figure 5:
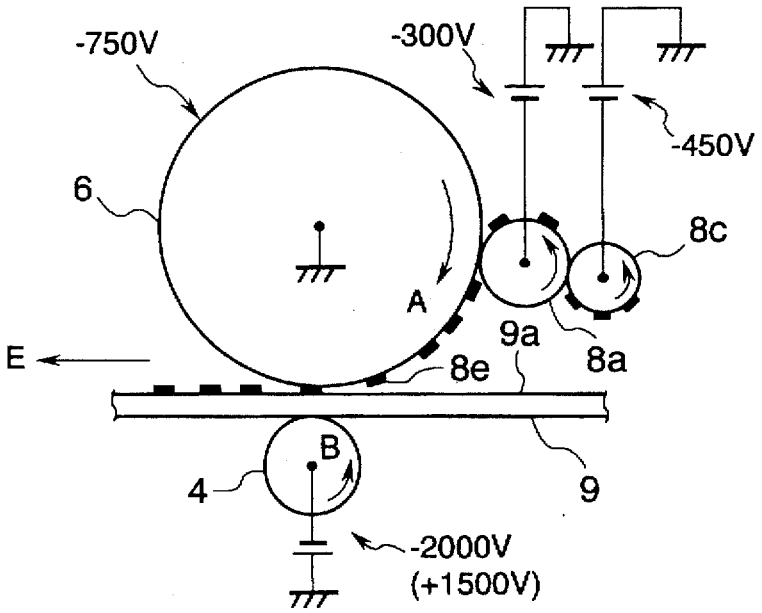
FIG. 5 is an explanatory diagram showing the state in which reverse-charged toner adheres to the carrier belt according to the first embodiment.

The operation by which image data is printed from this state is explained, with reference to FIG. 4 and FIG. 5. FIG. 4 is a timing chart showing the operation of printing according to the first embodiment, and FIG. 5 is an explanatory diagram showing the state in which reverse-charged toner adheres to the carrier belt 9 according to the first embodiment.

The control circuit 41 drives the motor 53 via the motor driver circuit 52 and, as shown at (A) in FIG. 4, drives the paper feed roller 26 for a specified period of time. By this means, one sheet of recording medium 27 in the cassette 21 is fed to the guides 28 and 29. The leading edge of the recording medium 27 is pressed between resist rollers 30 and 31 so that it sags slightly. By means of this sag, any skew of the recording medium 27 is corrected.

Next, the control circuit 41 drives the adhesion/charging power supply 46, and, as shown at (B) in FIG. 4, the driving motor 54 via the motor driver circuit 52. This causes the rotation of the resist rollers 30 and 31, the photosensitive bodies 6, the charging rollers 7, the developing rollers 8*a*, the sponge rollers 8*c*, and the transfer rollers 4 of the printing mechanisms $P_1$ through $P_4$ as well as the driver roller 10 of carrier belt 9, and the heat roller 36 of the Fixing unit 35. At the same time, as shown at (E), (G), (I), (K), (M), (O), (Q) and (S) in FIG. 4, the control circuit 41 drives the charging power supplies 44Y, 44M, 44C and 44B, the DB bias power supplies 43Y, 43M, 43C and 43B, and the SP bias power supplies 42Y, 42M, 42C and 42B, applying voltage to the charging rollers 7, the developing rollers 8*a*, and the sponge roller 8*c*, respectively. Using this timing, the control circuit 41 issues instructions to the polarity-switching circuit 45YA, 45MA, 45CA and 45BA of the transfer power supplies 45Y, 4SM, 45C and 4SB, supplying high-voltage power of negative polarity to the transfer rollers 4. By this means there is imparted, uniformly to the surfaces of the photosensitive bodies 6 via the charging rollers 7, a charge of −750 [IV], to the sponge rollers 8*c* a charge of −450 [V], to the developing rollers 8*a* a charge of −300 [V], and to the transfer rollers 4 a charge of −2,000 [IV].

Since the motor 54 continues to rotate, toner that is reverse-charged with positive polarity moves, as shown in FIG. 5, to the side having lower voltage. That is to say, reverse-charged toner 8*e*, which is present on the surface of the developing roller 8*a*, adheres to the photosensitive body 6, which is charged at −750 [IV], and the reverse-charged toner 8*e* that adheres to the surface of the photosensitive body 6 is attracted by the voltage of the transfer roller 4, which is charged at −2,000 [V], and adheres to the surface 9*a* of the carrier belt 9. Further, since the carrier belt 9 is moving in direction E, the reverse-charged toner 8*e* adhering to the surface 9*a* is removed by the cleaning blade 13 and is collected in the waste toner tank 14. The operation described above continues as long as the transfer roller 4 is charged with negative polarity at −2,000 [V]. In this way, reverse-charged toner adhering to developing roller 8*a* is removed.

During this period, when the leading edge of the recording medium 27 is detected by the photointerrupter 60 at time $t_1$, this event is used to time the output of a pulse by the control circuit 41. This output pulse is measured, providing the time to the beginning of writing by the LED heads 3 of the printing mechanisms $P_1$ through $P_4$, the time to the beginning and end of transfer, and the time to the starting and stopping of the discharging power supply 47.

Thus, based on the results of measurements, the control circuit 41 sends an instruction to the memory 49Y, which stores yellow image data, to send one line of yellow image data from the memory 49Y to the print control circuit 48Y. Based on the instruction from the control circuit 41, the print control circuit 48Y sends the image data from the memory 49Y to the LED head 3 of the printing mechanism $P_1$. The LED head 3 then causes the LEDs corresponding to the image data sent to emit light, forming on the surface of charged photosensitive body 6 one line of electrostatic latent image corresponding to the image data. In this way the yellow image data sent line by line from the memory 49Y is converted successively into a latent image on the surface of the photosensitive body 6, and when yellow image data equivalent to a length in the subscan direction parallel to the direction of transport has been converted into an electrostatic latent image, exposure ends.

During this period, the recording medium 27, which has passed the photointerrupter 60, is charged by the charger 32 and adheres electrostatically to the carrier belt 9.

The negative-polarity (i.e., normal polarity) yellow toner adhering to the developing roller 8*a* adheres to the electrostatic latent image formed on the surface of the photosensitive body 6, so that, with the rotation of the photosensitive body 6, the electrostatic latent images are successively developed by the yellow toner. Since the control circuit 41 is measuring the time required to the beginning and end of transfer, it outputs an instruction to the transfer power supply 45Y at the point at which the leading edge of the recording medium 27 comes between the photosensitive body 6 and the transfer roller 4, and, using the polarity-switching circuit 45YA, switches the polarity of the charge on the transfer roller 4 from negative to positive. The positive voltage is +1,500 [V]. Thus the toner image on the surface of the photosensitive body 6 is transferred electrically onto the recording medium 27 by means of positively charged transfer roller 4. As the photosensitive body 6 relates, the toner images are transferred successively onto the recording medium 27 until yellow image equivalent to one page is transferred to the recording medium 27. In this way the transfer to the recording medium 27 of the yellow image by the printing mechanism $P_1$ is completed.

Then, at the point at which the trailing edge of the recording medium 27 reaches the interval between the photosensitive body 6 and the transfer roller 4, the control circuit 41 outputs an instruction to the transfer power supply 45Y, and, using the polarity-switching circuit 45YA, switches the polarity of the charge on the transfer roller 4 from positive to negative. Thus, in the same way as the pre-transfer operation described above, the reverse-charged toner adheres to the carrier belt 9, is removed by the cleaning blade 13, and is collected in the waste toner tank 14.

As the carrier belt 9 continues to move, the recording medium 27 is carried from the printing mechanism $P_1$ to the printing mechanism $P_2$, and the transfer of the magenta toner image is carried out by the printing mechanism $P_2$.

The control circuit 41 outputs an instruction to the memory 49M, in which is stored the magenta image data, sending one line of magenta image data from the memory 49M to the print control circuit 48M. Upon receiving the instruction from the control circuit 41, the print control circuit 48M converts the image data from the memory 49M into a form that can be sent to the LED head 3 of the printing mechanism $P_2$ and sends it to the LED head 3. The LEAD head 3 causes the LEDs corresponding to the image data sent to it to emit light, forming on the charged surface of the photosensitive body 6 one line of electrostatic latent image corresponding to the image data.

In this way the magenta image data sent line by line from the memory 49M is converted successively into a latent image on the surface of the photosensitive body 6, and when magenta image data equivalent to a length in the subscan direction parallel to the direction of transport has been converted into an electrostatic latent image, exposure ends. The subsequent operations of the transfer of the magenta toner image and the switching of the polarity of the voltage applied to the transfer roller 4 are identical to the operations described above for the printing mechanism $P_1$, and their explanation is accordingly omitted.

The recording medium 27 is carried from the printing mechanism $P_2$ to the printing mechanism $P_3$, and the operations of the transfer of the cyan toner image and the switching of the polarity of the voltage applied to the transfer roller 4 by the printing mechanism $P_3$ are carried out in the same way as in the case of printing mechanism $P_1$. When the transfer of the cyan toner image is completed, the recording medium 27 is carried from the printing mechanism $P_3$ to the printing mechanism $P_4$, and the operations of the transfer of the black toner image and the switching of the polarity of the voltage applied to the transfer roller 4 by the printing mechanism $P_4$ are carried out in the same way as in the case of the printing mechanism $P_1$. In this way the toner images for each color are transferred successively onto the recording medium 27.

The recording medium 27 is then carried by the carrier belt 9 to the discharger 33, and at this point the control circuit 41 drives the discharging power supply 47 on the basis of the measurement results described above, thereby discharging the recording medium 27. By this means the recording medium 27, instead of being carried with the follower roller 11 in direction E, separates from the carrier belt 9, is carried to the guide 34, and is guided by the guide 34 to the fixing unit 35. At the point at which the recording medium 27 passes the discharger 33, the control circuit 41 turns off the discharging power supply 47.

At the fixing unit 35, the toner image is fixed to the recording medium 27 by means of the heat roller 36, which has already reached the temperature at which fixing is possible, and by the presser roller 37, which is forced against the heat roller 36. When fixing is completed, the recording medium 27 is ejected into the ejection stacker 39. The control circuit 41 discerns the ejection by the photointerrupter 61 detecting the trailing edge of the recording medium 27.

When the ejection is completed, the control circuit 41 stops the motor 54 via the motor driver circuit 52. It also turns off the charging power supplies 44Y, 44M, 44C and 44B, the SP bias power supplies 42Y, 42M, 42C and 42B, and the DB bias power supplies 43Y, 43M, 43C and 43B, completing the printing operation.

The operation of printing a single sheet of recording medium 27 is carried out in the manner described above. The printing of the second and subsequent sheets is emptied out by repeating the printing operation described above.

In the first embodiment, it is possible, through the movement of the carrier belt 9, to remove the reverse-charged toner adhering to the photosensitive body (from the developing roller **8*a* by imparting a negative charge to transfer roller 4, before the transferring process in which the normal-charged toner adhering to the surface of the photosensitive body 6 is transferred to the recording medium 27 for forming the image thereon. This results in no reverse-charged toner adhering to the photosensitive body 6 during the transferring process. Accordingly, there is no degradation of print quality due to the adherence of the reverse-charged toner to the background (white background) of the recording medium 27** during the transferring process.

Since, in the first embodiment, the reverse-charged toner is actively removed from the developing unit 8 before and after the transferring process, the problems that the reverse-charged toner may present will not occur. This reverse-charged toner is hard to develop and hard to transfer, would otherwise remain in the developing unit 8, and the amount of the hard-to-develop, hard-to-transfer reverse-charged would increase in quantity every time toner is supplied from the toner tank **8*d*, thereby decreasing the developing capacity of the developing unit 8. Accordingly, developing capacity is extended and the life of the developing unit 8** is increased.

It is also possible, when continuously printing a plurality of sheets of recording medium 27 using the electrophotographic recording apparatus 1 of the first embodiment, to carry out the process of recovering reverse-charged toner before the beginning of printing, then to omit the recovery process during the course of continuous transfer and printing, and, when the final sheet has been completed, to repeat the recovery process, thereby completing the printing operation. In this case, more rapid printing is made possible.

SECOND EMBODIMENT

In the first embodiment, the reverse-charged toner is removed from the developing unit 8 both before and after the transferring process, but in the second embodiment, the reverse-charged toner adhering to the charging roller 7 is removed only after the transferring process.

Figure 6:
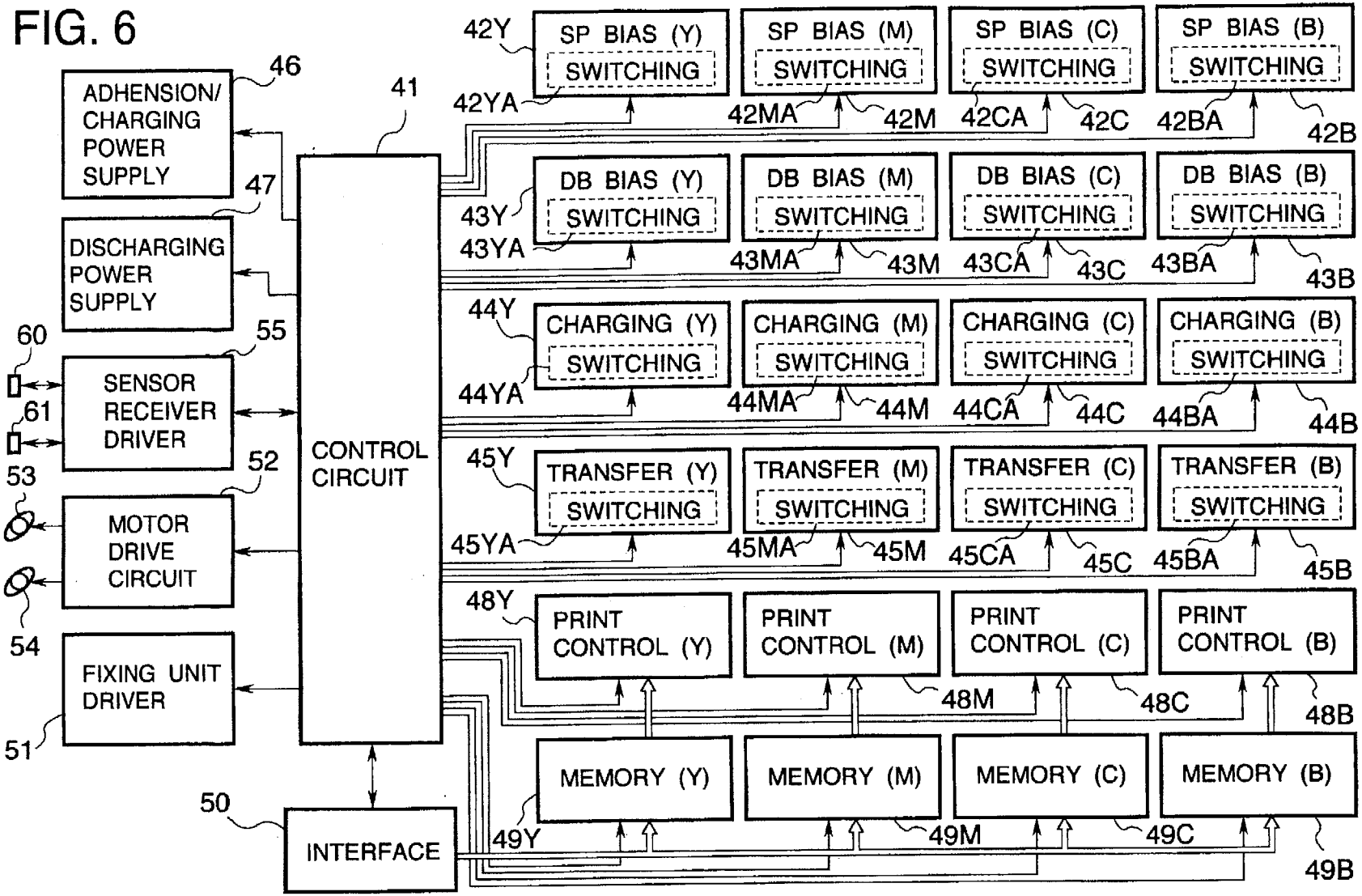
FIG. 6 is a block diagram showing a control system of an electrophotographic recording apparatus according to a second embodiment of the present invention.

FIG. 6 is a block diagram showing the control system of an electrophotographic recording apparatus according to the second embodiment. As shown in FIG. 6, the charging power supplies 44Y, 44M, 44C and 44B are respectively provided with polarity switching circuits 44YA, 44MA, 44CA and 44BA that switch the polarity of the voltage applied to the charging roller 7 so that the direction of the electrical field between the charging roller 7 and the photosensitive body 6 is opposite to that during the charging process. Further, the SP bias power supplies 42Y, 42M, 42C and 42B are respectively provided with polarity switching circuits 42YA, 42MA, 42CA and 42BA that switch the polarity off the voltage applied to the sponge roller 8*c* and the DB bias power supplies 43Y, 43M, 43C and 43B are respectively provided with polarity switching circuits 43YA, 43MA, 43CA and 43BA that switch the polarity of the voltage applied to the developing roller 8*a*. The other structures are similar to those of the first embodiment, and their explanation is accordingly omitted.

Following is an explanation of the printing operation of an of an electrophotographic recording apparatus 1 in accordance with this second embodiment.

Figure 7:
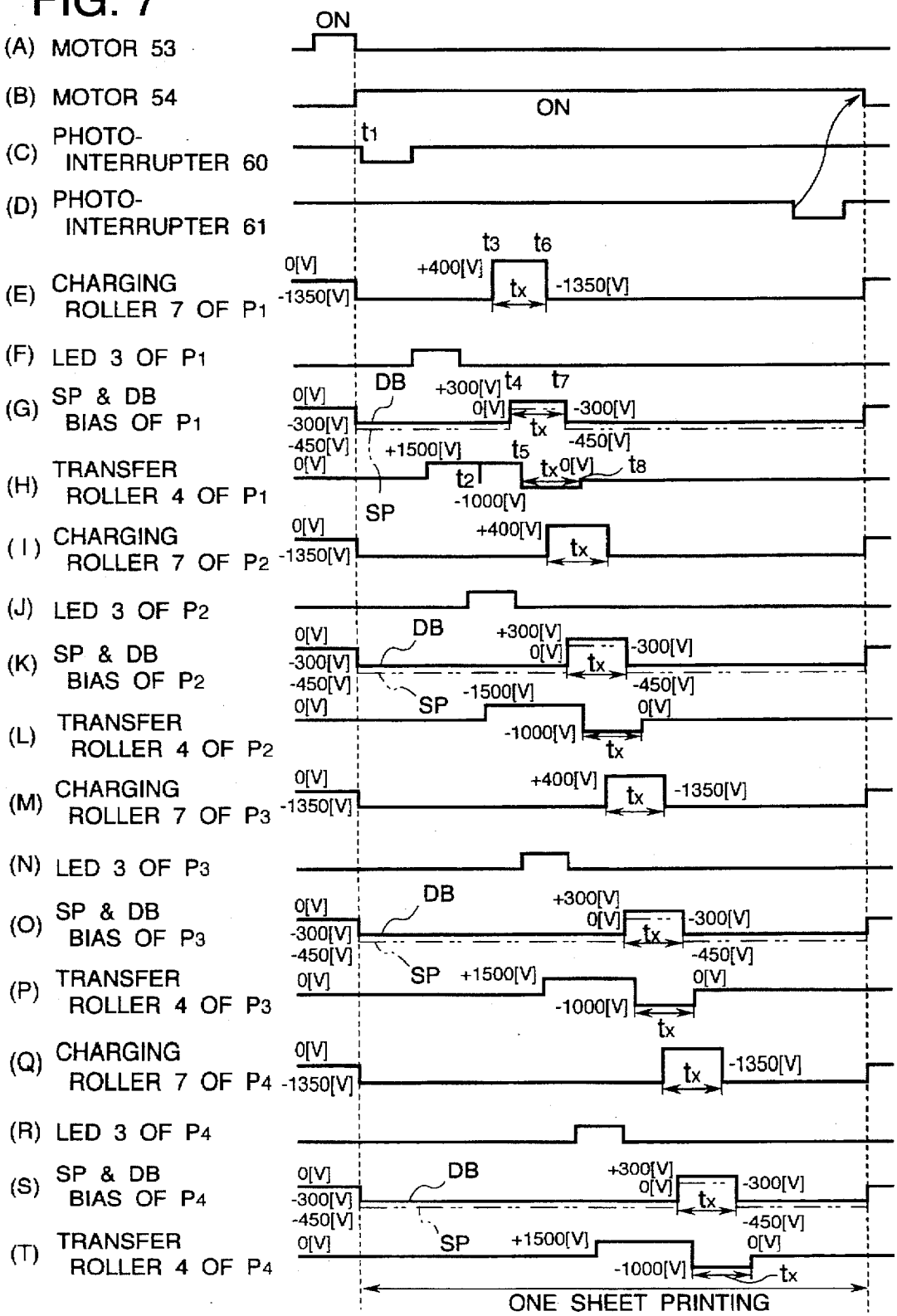
FIG. 7 is a timing chart showing the printing operation according to the second embodiment.

When the power supply is turned on, the control circuit 41 carries out the specified initial set-up, after which it drives the fixing unit driver 51 so that the heat roller 36 of the -fixing unit 35 warms up to the specified temperature. By this means the initial settings are completed. Subsequent operations up to the point at which the image data from the host computer have been stored by color in the memories 49Y, 49M, 49C and 49B are similar to those of the first embodiment, and their explanation is accordingly omitted; the present explanation proceeds from the operation of printing the image data. Note, however, that of the image data printing operations, the operation of advancing the recording medium 27 sheet by sheet from the cassette 21, and correcting skew is similar to that of the first embodiment, and its explanation is accordingly omitted. FIG. 7 is a timing chart showing the operation of printing according to the second embodiment, and FIG. 8A through FIG. 8D are explanatory diagrams showing the operation of removing reverse-charged toner according to the second embodiment.

Next, the control circuit 41 drives the adhesion/charging power supply 46, and, as shown at (B) in FIG. 7, the drives motor 54 via the motor drive circuit 52, thereby causing the rotation of the resist rollers 30 and 31, the photosensitive bodies 6, the charging rollers 7, the developing rollers 8*a*, the sponge rollers 8*c*, and the transfer rollers 4 of the printing mechanisms $P_1$ through $P_4$, as well as the driver roller 10 of the carrier belt 9, and the heat roller 36 of the fixing unit 35. At the same time, as shown at (E), (G), (I), (K), (M), (O), (Q) and (S) in FIG. 7, the control circuit 41 drives the charging power supplies 44Y, 44M, 44C and 44B applying voltage to the charging rollers 7, the DB bias power supplies 43Y, 43M, 43C and 43B applying voltage to the developing rollers 8*a*, and the SP bias power supplies 42Y, 42M, 42C and 42B applying voltage to the sponge rollers 8*c*.

By this means, a change of −1,350 [V] is imparted to the charging rollers 7 of printing mechanisms $P_1$ through $P_4$, a change of −300 [V] to the developing rollers 8*a* of the printing mechanisms $P_1$ through $P_4$ and a charge of −450 [V] to the sponge rollers 8*c* of the printing mechanisms $P_1$ through $P_4$. A charge of −750 [V] is uniformly imparted to the photosensitive bodies 6 of the printing mechanisms $P_1$ through $P_4$ is imparted uniformly, via the charging rollers 7. The electrical field between the charging rollers 7 and the photosensitive bodies 6 at this time is oriented in the direction from the photosensitive body 6 to the charging roller 7.

When the leading edge of the recording medium 27 is detected by the photointerrupter 60 at a time $t_1$, a pulse is outputted by the control circuit 41, providing estimates of the time periods required to the beginning of writing by the LED heads 3 of the printing mechanisms $P_1$ through $P_{hd\ 4}$, the time periods required to the beginning and end of the transfer process, and the time periods required to the starting and stopping of discharging power supply 47. Based on the results of the estimates, the control circuit 41 sends yellow image data from the memory 49Y to the print control circuit 48Y. Also, during this period, the recording medium 27, which has passed the photointerrupter 60, is charged by the charger 32 and adheres electrostatically to the carrier belt 9 in a manner similar to that of the first embodiment.

Figure 8A:
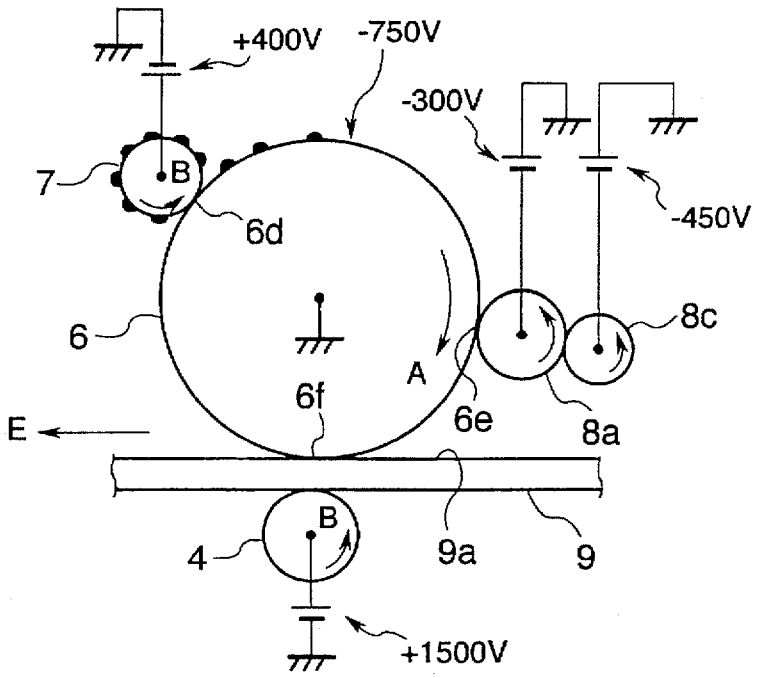
FIGS. 8A–8D are explanatory diagrams showing the removing of the reverse-charged toner according to the second embodiment.

The subsequent operations up to the transfer process of the yellow toner image by the printing mechanism $P_1$ are as explained in the first embodiment, and their explanation is accordingly omitted. Since the voltage applied to the charging roller 7 off the printing mechanism $P_1$ is a bias voltage of negative polarity that is lower than the voltage of the photosensitive body 6, the reverse-charged toner is, at the end of the transfer process off the yellow toner image, adhered to the charging roller 7, as shown in FIG. 8A. If charging were carried out in this state, the charged voltage of the photosensitive body 6 would be reduced (to the vicinity of 0 [V]). As a result, the negative-polarity toner on the non-image portion of the photosensitive body 6 would be developed by the developing roller 8*a*, contaminating the surface of the photosensitive body 6. Accordingly, the reverse-charged toner adhering to the charging roller 7 is returned to the photosensitive body 6, and this reverse-charged toner transferred to the carrier belt 9 and removed off by the cleaning blade 13. The following is a detailed explanation of this operation.

When the transfer process ends at time $t_2$, the control circuit 41 measures the time period until the photosensitive body 6 shifts to a point 6*d* of contact with the charging roller 7 (the period from time $t_2$ to $t_3$), the time period from the contact point 6*d* to the point 6*e* of contact with the developing roller 8*a* (the period from time $t_3$ to $t_4$), and the time period from the contact point 6*e* to the transfer point 6*f* (the period from time $t_4$ to $t_5$). Then, at time $t_3$, the control circuit 41 outputs a control signal to the charging power supply 44Y, based upon which the polarity-switching circuit 44YA switches the voltage applied to the charging roller 7 of the printing mechanism $P_1$ from −1,350 [V] to +400 [IV]. Accordingly the direction of the electrical field between the charging roller 7 and the photosensitive body 6 is changed to the opposite of that during the charging process, that is to say, from the charging roller 7 toward the photosensitive body 6. Also the difference in potential between the charging roller 7 and the photosensitive body 6 at this time is set at a value at which the reverse-charged toner is readily transferred From the charging roller 7 to the photosensitive body 6. According to experimental results, a voltage of approximately +400 [V] output from the charging roller 7 is satisfactory, but it is equally possible, provided the direction of the electrical field is opposite to that during charging and the potential difference is such that the reverse-charged toner transfers readily to the photosensitive body 6. For the voltage not to be limited to +400 [V], and, under certain circumstances, for the voltage to the charging roller 7 to be turned off.

Figure 8B:
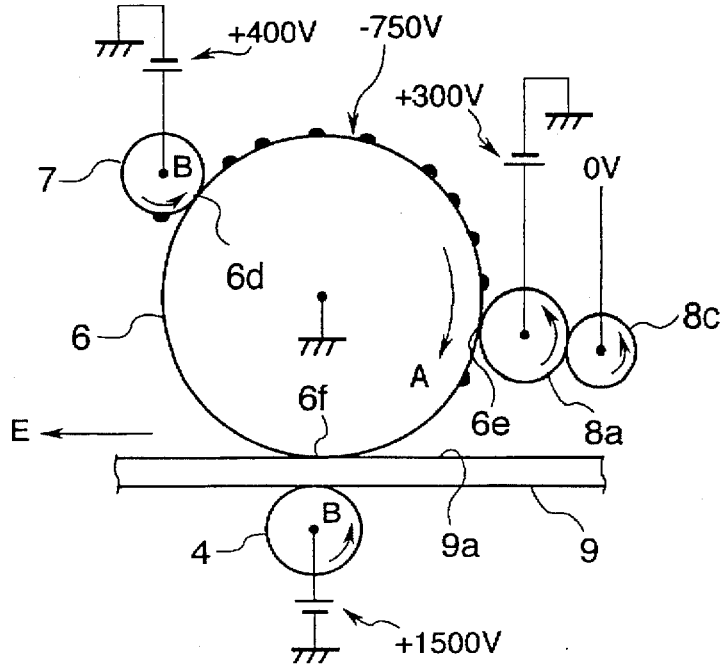

Since the reverse-charged toner moves toward the side having the lower voltage, the switching of the voltage on the charging roller 7 to positive polarity means, as shown in FIG. 8A, that the reverse-charged toner adhering to the charging roller 7 moves to the photosensitive body 6, which is negatively charged. Since the charging roller 7 and the photosensitive body 6 are rotating, the reverse-charged toner that moved to the photosensitive body 6 as the rotation proceeds is carried toward the developing roller 8*a*. Further, at time $t_4$, the control circuit 4 outputs control signals to the SP bias power supply 42Y and the DB bias power supply 43Y, based upon which the polarity-switching circuits 42YA and 43YA of the SP power supply 42Y and DB power supply 43Y impart a charge of 0 [V] to the sponge roller 8*c* and a charge of +300 [V] to the developing roller 8*a*. Accordingly the reverse-charged toner adhering to the photosensitive body 6 will, as shown in FIG. 8B, move past the contact point 6*e*, without being attracted to the developing roller 8*a* at the contact point 6*e*.

Figure 8C:
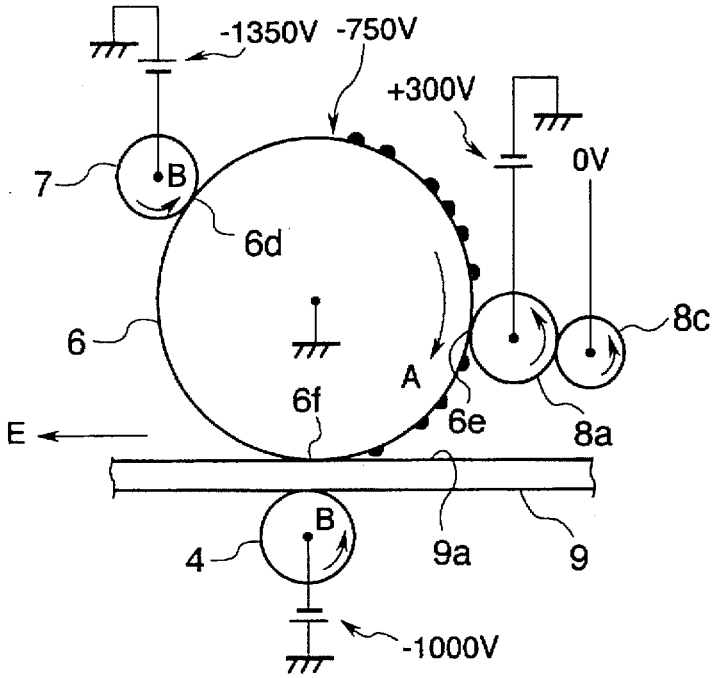
Figure 8D:
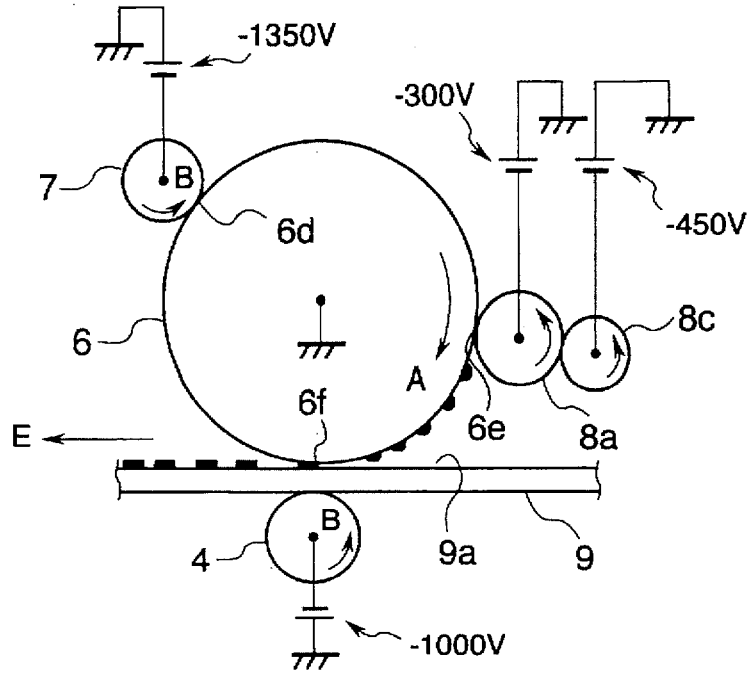

Next, at time $t_5$, the control circuit 41 outputs a control signal to the transfer power supply 45Y, based upon which the polarity-switching circuit 45YA of the transfer power supply 45Y applies to transfer roller 4 a voltage of −1,000 [V] (refer to FIG. 8C). By this means, the transfer roller 4 has a lower voltage than the photosensitive body 6 and the electrical field is oriented in the direction from the photosensitive body 6 toward the transfer roller 4, with the result that the reverse-charged toner adhering to the photosensitive body 6 is attracted by the voltage on the transfer roller 4 and adheres to the surface 9*a* of the carrier belt 9. During the period from time $t_3$ to time $t_6$ (period $t_x$), the charging roller 7 makes a plurality of rotations, but at time $t_6$, the control circuit 41 once more outputs a control signal to the charging power supply 44Y, based upon which the polarity-switching circuit 44YA applies to the charging roller 7 a voltage of −1,350 [V]. The number of rotations of the charging roller 7 during period $t_x$ is set for that case in which the amount of reverse-charged toner adhering to the charging roller 7 is set experimentally to be the greatest, at such a number that all of the adhering the reverse-charged toner can move to the photosensitive body 6.

Further, as shown in FIG. 7, the control circuit 41 outputs instructions such that a charge of 0 [IV] is imparted to the sponge roller 8*c* and a charge of +300 [IV] is imparted to the developing roller 8*a* from time $t_4$ to time $t_7$, which is the same period as groin time $t_3$ to time $t_6$ (period $i_x$). By this means, all of the reverse-charged toner that has moved from the charging roller 7 to the photosensitive body 6 can pass the contact point 6*e* while adhering to the photosensitive body 6 and be carried to the transfer point 6*f*.

The control circuit 41 also imparts to the transfer roller 4 a charge of −1000 [V] for a period of $t_x$ from time $t_5$ to time $t_8$. By this means, all of the reverse-charged toner that has adhered to the photosensitive body 6 is moved to the carrier belt 9 at the transfer point 66. Since the carrier belt 9 is moving in the direction E, the reverse-charged toner adhering to the surface 9*a* of the carrier bell 9 is then moved to the printing mechanism $P_2$.

At the printing mechanism $P_2$, the magenta image data is sent from the memory 49M to the print control circuit 48M based on the results of the judgments of the control circuit 41, and charging by the charging roller 7, exposure by the LED head 3, and developing by the developed roller 8*a* are carried out. When, due to the movement of the carrier belt 9, the recording medium 27 is carried from the printing mechanism $P_1$ to the printing mechanism $P_2$, the transfer of the magenta toner image by the printing mechanism $P_2$ is carried out. The details are similar to those for the printing mechanism $P_1$, and their explanation is accordingly omitted. The operations subsequent to the end of the transferring process of the magenta toner image by the printing mechanism $P_2$, that is, of moving the reverse-charged toner from the charging roller 7 to the photosensitive body 6 and thence to the carrier belt 9, are as described above, and their explanation is also omitted.

The recording-medium 27 is then carried from the printing mechanism $P_2$ to the printing mechanism $P_3$, and the operations of the transfer of the cyan toner image and, after the end of the transferring process, off the movement of the reverse-charged toner to the carrier bell 9 by the printing mechanism $P_3$ are carried out in a manner similar to those of the printing mechanism $P_1$. The recording, medium 27 is then carried from the printing mechanism $P_3$ to the printing mechanism $P_4$ and the operations of the transfer of the black toner image and, after the end of the transferring process, the movement of reverse-charged toner to the carrier belt 9 by the printing mechanism $P_4$ are carried out in a manner similar to those of the printing mechanism $P_1$. As described above, the toner images of each color are transferred successively onto the recording medium 27. Note that during the period in which that portion of the carrier belt 9 to which reverse-charged toner adheres passes the printing mechanisms $P_1$ through $P_4$, a voltage of −1000 [V] is applied to each of the transfer rollers 4 and a voltage of −750 [V] is applied to each of the photosensitive bodies 6 (the state shown in FIG. 8D), so that the electrical field between each of the photosensitive body 6 and the transfer roller 4 proceeds from the photosensitive body 6 toward the transfer roller 4. Thus the reverse-charged toner adhering to the carrier belt 9 can pass contact point 6*f*, without once more adhering to the photosensitive body 6, and be carried to the cleaning blade 13. Then the reverse-charged toner is removed by the cleaning blade 13 and collected in the waste toner tank 14.

After the transferring process of all colors has been completed, the printing operations up until the recording medium 27 is carried to the fixing unit 35, and has, after fixing, been ejected into the ejection stacker 39, are similar to those of the first embodiment, and their explanation is accordingly omitted.

The operation of printing a single sheet of recording medium 27 is carried out in the manner described above. The printing of a second sheet and subsequent sheets is carried out by repeating the printing operation described above.

Figure 9:
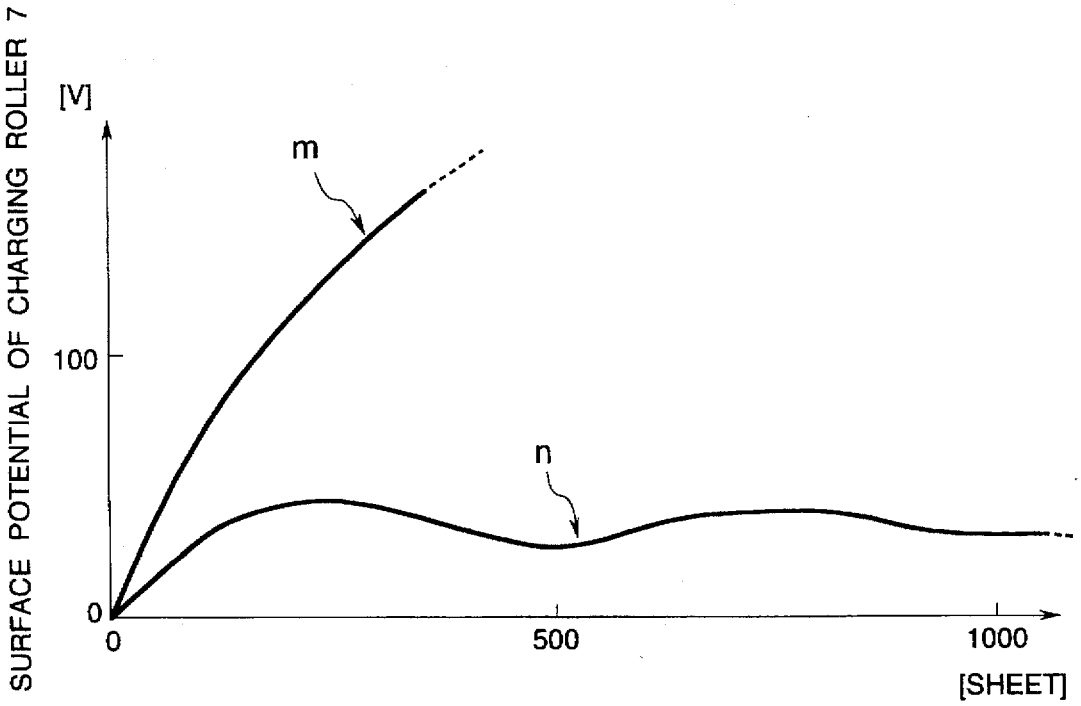
FIG. 9 is a graph showing the relationship between the amount of reverse-charged toner adhering to a charging roller and the number of sheets of recording medium, according to the second embodiment.

Here, the results of experiments in which the amount of reverse-charged toner adhering to the charging roller 7 during continuous printing using an electrophotographic printer according to the second embodiment at a duty factor of 20% (where the solid printing of the whole of the printable area of the recording medium 27 is 100%) are explained with reference to FIG. 9. FIG. 9 is an explanatory diagram showing the relationship between the amount of the reverse-charged toner adhering to a charging roller according to the second embodiment and the number of sheets of recording medium 27 printed, in which the ordinate is the surface potential of the charging roller 7 and the abscissa is the number of sheets printed. The surface potential of the charging roller 7 represents the potential of the layer of the reverse-charged toner adhering to the charging roller 7, and the potential of the toner layer and the thickness of the toner layer are in a substantially proportionate relationship. Thus, the surface potential of the charging roller 7 represents toner layer thickness. Curve m in FIG. 9 shows the case in which the reverse-charged toner adhering to the charging roller 7 is not recovered, and curve n shows the case in which the reverse-charged toner adhering to the charging roller 7 is recovered each time one sheet is printed.

When the reverse-charged toner adhering to the charging roller 7 is not removed, the amount of adhering reverse-charged toner increases with an increase in the number of sheets printed, as shown by curve m, and, by the time that approximately 300 sheets of recording medium 27 have been printed, the fouling of the photosensitive body 6 and the recording medium 27 has become so severe that continued printing becomes impossible. When, however, as explained in the second embodiment, the reverse-charged toner adhering to the charging roller 7 is recovered each time one sheet of recording medium 27 is printed, a certain amount of reverse-charged toner may remain, as shown by curve n, but the toner layer does not reach a thickness such as to bring about a reduction in the charge voltage of the photosensitive body 6, and it was confirmed that even after the printing of 1,000 sheets, there was no fouling whatsoever of the photosensitive body 6 and the recording medium 27.

In the second embodiment, since the reverse-charged toner adhering to the charging roller 7 is removed, it is possible to prevent fouling of the photosensitive body 6 due to reduction in the charge potential of the photosensitive body 6. As a result, there is no fouling of the recording medium 27 during printing, and it is possible to secure high print quality for a longer period of time.

In the second embodiment, the reverse-charged toner adhering to the charging roller 7 after the end of transferring process is removed, but if, as in the first embodiment, the reverse-charged toner adhering to the surface of the developing roller 8*a* is removed by the application of a voltage of −1,000 [V], which is lower than the surface voltage of the photosensitive body 6, to the transfer roller 4 at the point at which the motor 54 starts, the amount of reverse-charged toner within the developing unit 8 can be further reduced. Further, in the second embodiment, a voltage of negative polarity is applied to the transfer roller 4 for a period of time $t_X$ after the transferring process, but if, as in the first embodiment, a voltage of −1,000 [V] is applied to the transfer roller 4 in the interval after the printing of each sheet of recording medium 27, the amount of reverse-charged toner within the developing unit 8 can be further reduced.

Moreover, by adding to the first embodiment the method that was described in the second embodiment, whereby the voltage applied to the charging roller 7 is switched after the end of the transferring process, thereby causing the reverse-charged toner adhering to the charging roller 7 to move to the photosensitive body 6, it is also possible to remove the reverse-charged toner that adhered, after the end of the transferring process, to the charging roller 7 of the first embodiment.

THIRD EMBODIMENT

Figure 10:
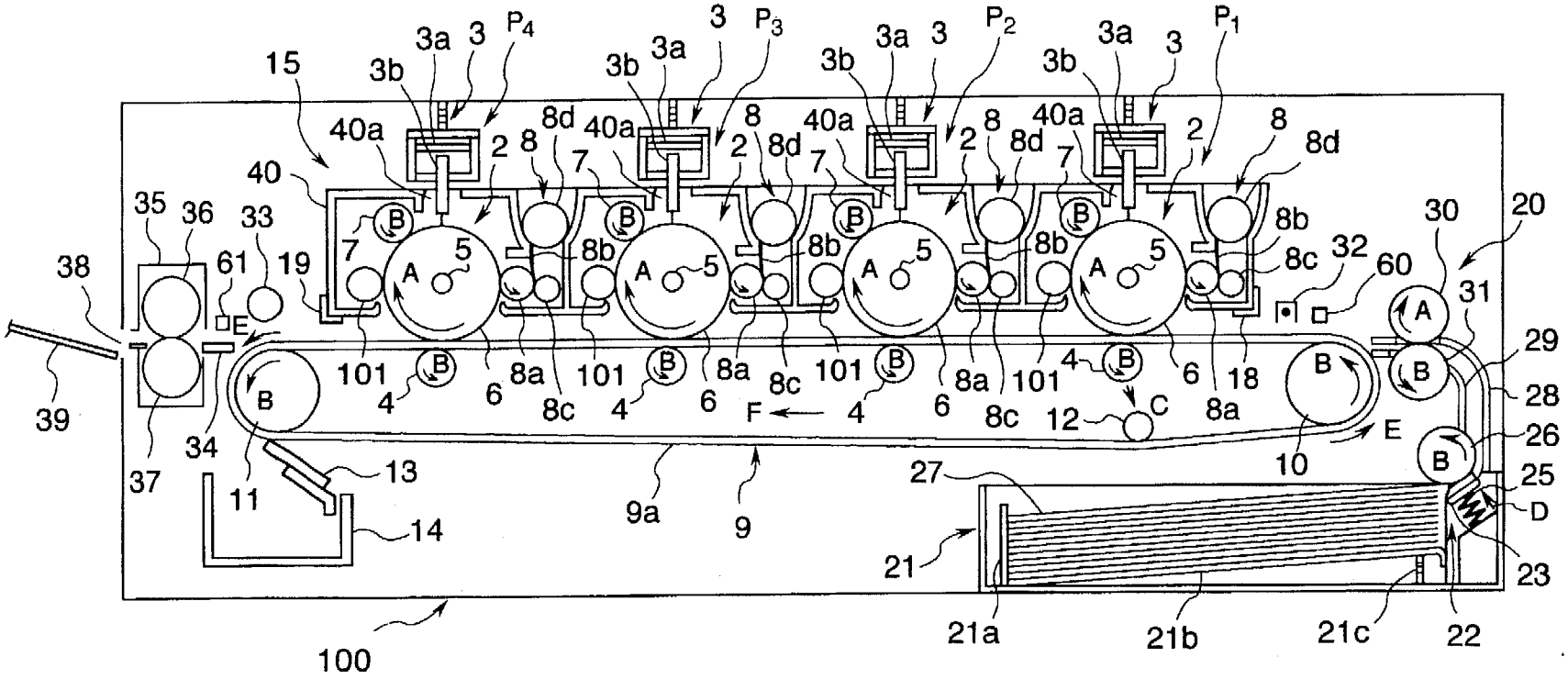
FIG. 10 is a structural schematic diagram showing an electrophotographic recording apparatus according to a third embodiment of the present invention.
Figure 11:
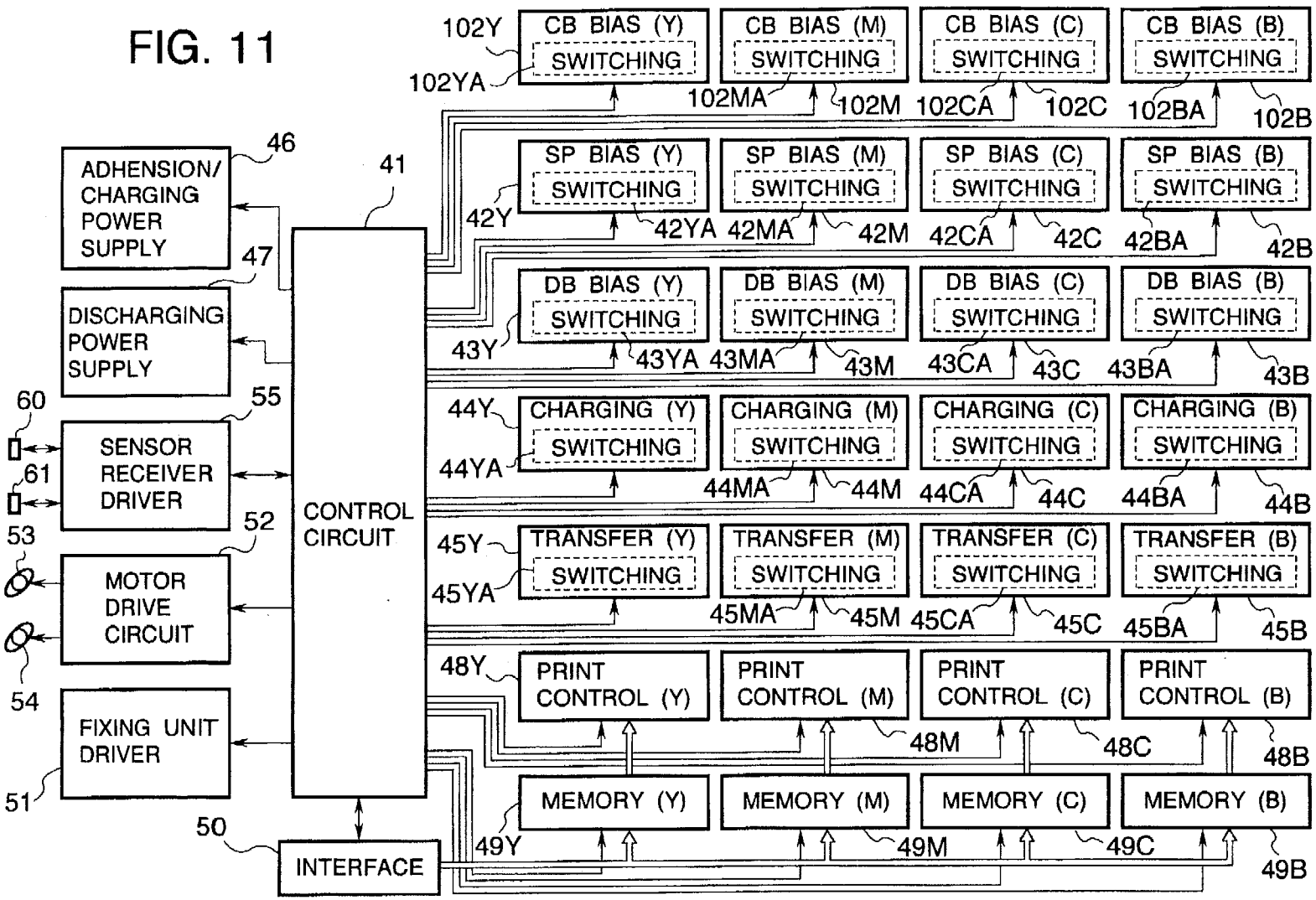
FIG. 11 is a block diagram showing a control system of the electrophotographic recording apparatus according to the third embodiment.

FIG. 10 is a structural schematic diagram showing an electrophotographic recording apparatus according to the third embodiment, and FIG. 11 is a block diagram showing the control system of the electrophotographic recording apparatus according to the third embodiment. In an electrophotographic recording apparatus 100 according to the third embodiment, each of printing mechanisms $P_1$, $P_2$, $P_3$ and $P_4$ comprises a cleaning roller 101 that temporarily captures the reverse-charged toner that has adhered to the respective photosensitive bodies 6.

The electrophotographic recording apparatus 100 is a color image recording device in which each of the printing mechanisms $P_1$, $P_2$, $P_3$ and $P_4$ is provided with a cleaning roller 101 that is in contact with the respective photosensitive body 6. The cleaning roller 101 is disposed upstream from the charging roller 7 with respect to the direction of rotation of the photosensitive body 6 (direction A) , and further along direction A from the transfer point.

The following is an explanation of the control system of the third embodiment with reference of FIG. 11. FIG. 11 is a block diagram showing the control system according to the third embodiment.

The control circuit 41 is connected to CB bias power supplies 102Y, 102M, 102C and 102B, which supply power to the cleaning roller 101. Each of CB bias power supplies 102Y, 102M, 102C and 102B is provided with a polarity-switching circuit 102YA, 102MA, 102CA and 102BA respectively. Each of the polarity-switching circuits 102YA, 102MA, 102CA and 102BA switches the polarity of the voltage applied to the respective cleaning roller 101 under the control of the control circuit 41.

Other structures are similar to those of the second embodiment, and their explanation is accordingly omitted.

Figure 12:
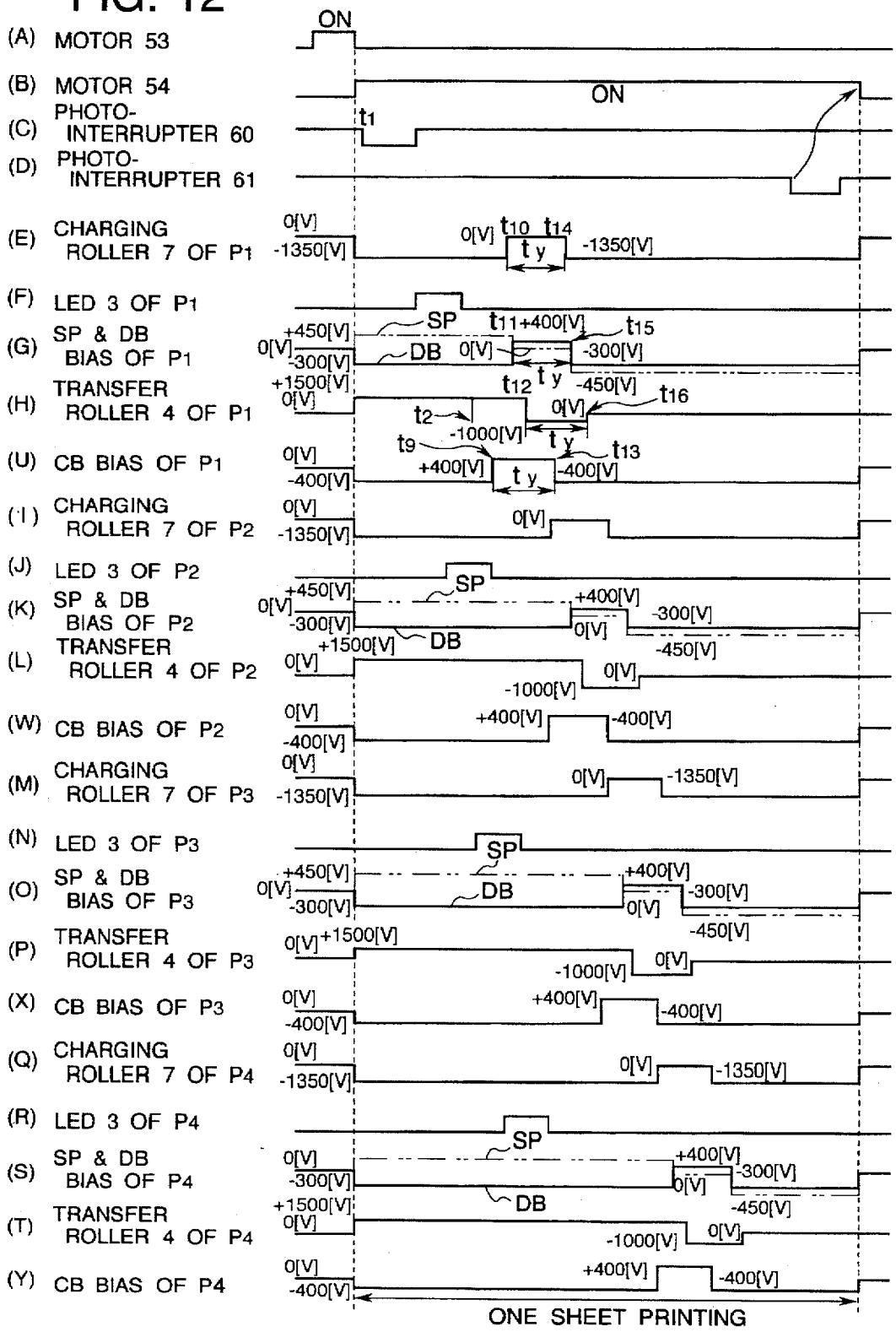
FIG. 12 is a timing chart showing the printing operation of the electrophotographic recording apparatus according to the third embodiment.

The following is an explanation of the printing operation using of the electrophotographic recording apparatus 100 according to the third embodiment. Note that the operations from turning on the power supply to Feeding a sheet of recording medium 27 from the cassette 21 and correcting the skew are similar to those of the second embodiment, and their explanation is accordingly omitted. FIG. 12 is a timing chart showing the operation of printing according to the third embodiment, and FIG. 13A through FIG. 13D) are explanatory diagrams showing the operation of removing reverse-charged toner according to the third embodiment.

After correction of the skew of the recording medium 27, the control circuit 41 energizes the adhesion/charging power supply 46 and at the same time, as shown at (B) in FIG. 12, drives the motor 54, thereby causing the rotation of the resist rollers 30 and 31, the photosensitive bodies 6, the charging rollers 7, the developing rollers 8*a*, the sponge rollers 8*c* and the transfer roller 4 of the printing mechanisms $P_1$ through $P_4$, as well as the driver roller 10 of the carrier belt 9, and the heat roller 36 of the fixing unit 35. Simultaneously, as shown at (E), (G), (H), (I), (K), (L), (M), (0), (P), (Q), (S), (T), (U), (W), (X) and (Y) in FIG. 12, the control circuit 41 energizes the charging power supplies 44Y, 44M, 44C and 44B, the DB bias power supplies 43Y, 43M, 43C and 43B, the SP bias power supplies 42Y, 42M, 42C and 42B and the transfer power supplies 45Y, 45M, 45C and 45B, as well as the (DB bias power supplies 102Y, 102M, 102C and 102B, thereby applying voltage to the charging rollers 7, the developing rollers 8*a*, the sponge rollers 8*c*, the transfer rollers 4 and the cleaning rollers 101.

Figure 13A:
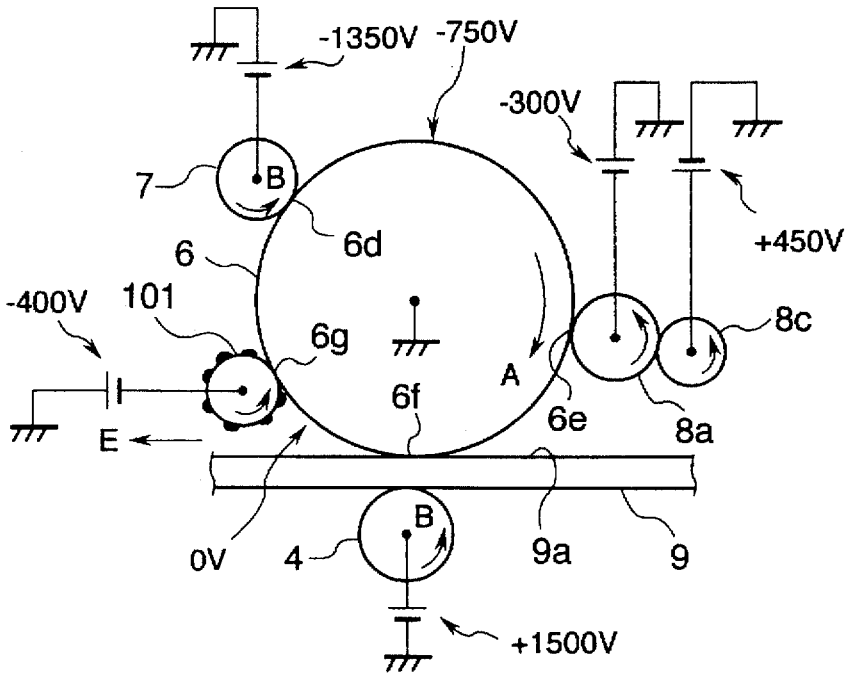
FIGS. 13A–13D are explanatory diagrams showing the removing of the reverse-charged toner according to the third embodiment.

By this means, in each of the printing mechanisms $P_1$ through $P_4$ is imparted, as shown in FIG. 13A, to the charging rollers 7 a charge of −1,350 [V], to the developing rollers 8*a* a charge of −300 [V], to the sponge rollers 8*c* a charge of +450 [V], to the transfer rollers 4 a charge of +1,500 [V], and to the cleaning rollers 101 a charge of −400 [V]. A charge of −750 [V] is also imparted to the surface of the photosensitive body 6 via the charging roller 7. Due to the surface potential of the transfer roller 4, the surface potential of the transfer point 6*f* of the photosensitive body 6 becomes 0 [V], and through rotation in the direction A, again becomes −750 [V] at the contact point 6*d*. Accordingly, the electrical field between the photosensitive bodies 6 and the cleaning rollers 101 at contact point 6*g* is oriented in the direction from the photosensitive body 6 to the cleaning roller 101, and at the contact point 6*d* the electrical field is oriented in the direction from the charging roller 7 to the photosensitive body 6. Thus, when there is reverse-charged toner adhering to the photosensitive body 6, that portion to which the reverse-charged toner adheres is moved to the cleaning roller 101 at the point 6*g* of contact with the cleaning roller 101, and thus does not adhere to the charging roller 7.

When the transferring process ends at time $t_2$, the control circuit 41 measures the time period until the ending point of transfer on the photosensitive body 6 shifts to point 6*g* of contact with cleaning roller 101 (the period from time $t_2$ to $t_9$), the time period until this ending point of transfer shifts from contact point 6*g* to point 6*d* of contact with the charging roller 7 (the period from time $t_9$ to $t_{10}$), the time period until this ending point of transfer shifts from the contact point 6*d* to the point 6*e* of contact with the developing roller 8*a* (the period from time $t_{10}$ to $t_{11}$), and the time period until this ending point of transfer returns from contact point 6e to the transfer point 6*f* (the period from time $t_{11}$ to $t_{12}$).

At time $t_9$, the control circuit 41 outputs a control signal to the CB bias power supply 102Y, based upon which the polarity-switching circuit 102YA switches the voltage applied to the cleaning roller 101 from −400 [V] to +400 [V]. The surface voltage of that portion of the photosensitive body 6 passing the transfer point 6*f* becomes 0 [V] due to the voltage applied to the transfer roller 4, and accordingly the electrical field between the cleaning roller 101 and the photosensitive body 6 is oriented in the direction from the cleaning roller 101 toward the photosensitive body 6. By this means, the reverse-charged toner that was adhering to the cleaning roller 101 is transferred to the photosensitive body 6. The potential difference between the cleaning roller 101 and the photosensitive body 6 at this Lime is to be set by experiment in such a way that the reverse-charged toner transfers readily from the cleaning roller 101 to the photosensitive body 6. Since the cleaning roller 101 and the photosensitive body 6 are rotating, the reverse-charged toner that is carried by the rotation to the photosensitive body 6 is sent in the clockwise direction A of FIG. 13B toward the developing roller 8*a*.

Figure 13B:
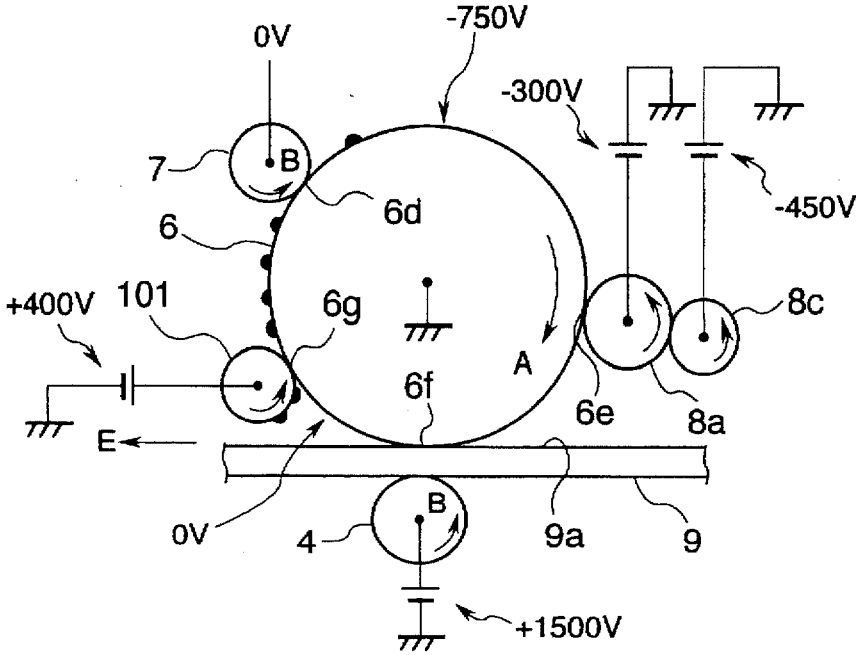

At time $t_{10}$, the control circuit 41 outputs a control signal to the transfer power supply 45Y, based upon which the polarity-switching circuit 45YA switches the voltage applied to the charging roller 7 from −1,350 [V] to 0 [V]. Accordingly, as shown in FIG. 13B, the reverse-charged toner adhering to the photosensitive body 6 passes the contact point 6*d* without being attracted to the charging roller 7. Even if, at this time, there is some reverse-charged toner adhering to the charging roller 7, it can be moved to the photosensitive body 6 by means of the difference in potential between the charging roller 7 and the photosensitive body 6.

Figure 13C:
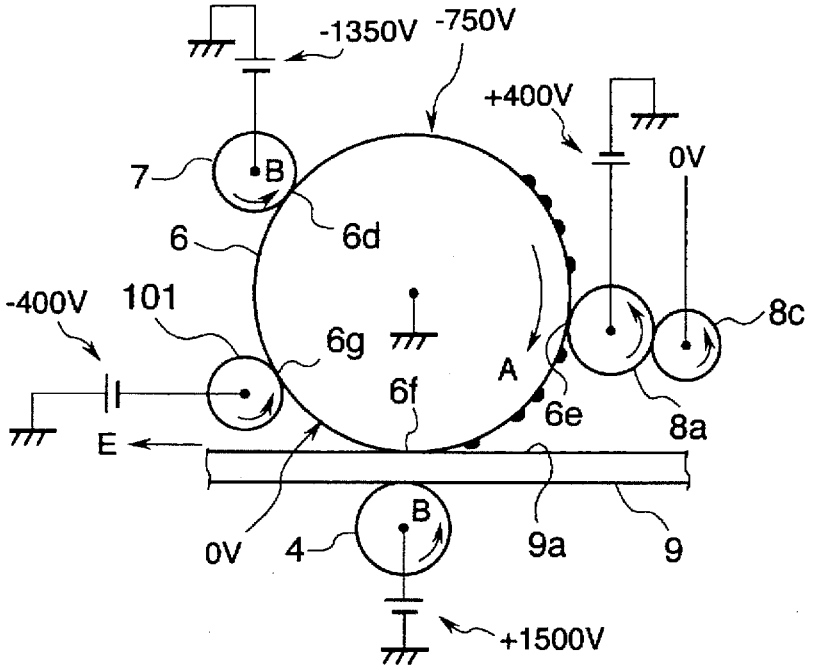
Figure 13D:
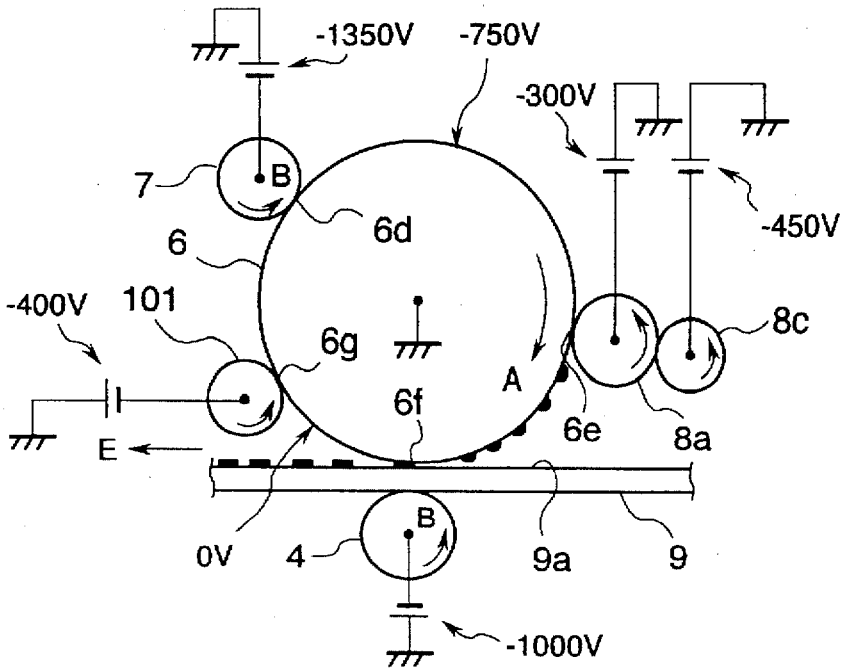

At time $t_{11}$, the control circuit 41 outputs control signals to the SP bias power supply 42Y and the DB bias power supply 43Y, based upon which the polarity-switching circuits 42YA and 43YA of the power supplies 42Y and 43Y impart charges of 0 [V] to the sponge roller 8*c* and +400 [V] to the developing roller 8*a*. Accordingly, as shown in FIG. 13C, the reverse-charged toner adhering to the photosensitive body 6 passes the contact point 6*e* without being attracted to the developing roller 8*a* at the contact point 6*e*. At time $t_{12}$, the control circuit 41 outputs a control signal to the transfer power supply 45Y, based upon which the polarity-switching circuit 45YA of the transfer power supply 45Y applies a voltage off −1,000 [V] to the transfer roller 4 (refer to FIG. 13D). By this means, the electrical field between the transfer roller 4 and the photosensitive body 6 is oriented in the direction from the photosensitive body 6 toward the transfer roller 4, so that the reverse-charged toner adhering to the photosensitive body 6 is attracted by the voltage of the transfer roller 4 and adheres to the surface 9*a* of the carrier belt 9.

During the period from time $t_9$ to time $t_{13}$ (period $t_y$), the cleaning roller 101 makes a plurality of rotations, and the number of rotations made by the cleaning roller 101 during period $t_y$ is such that when the amount of reverse-charged toner adhering to the cleaning roller 101 is set experimentally to be the maximum, all of the adhering reverse-charged toner can be moved to the photosensitive body 6. The control circuit 41 further imparts a charge of 0 [V] to the charging roller 7 for a period from time $t_{10}$ to time $t_{14}$, which is identical to period $t_y$. By this means, as shown in FIG. 13B, all of the reverse-charged toner that moved from the cleaning roller 101 to the photosensitive body 6 adheres to the photosensitive body 6, and can all be carried past the contact point 6d to the contact point 6*e*. Again, the control circuit 41 imparts a charge of 0 [V] to the sponge roller 8*c* and a charge of +400 [V] to the developing roller 8*a* for a period from time $t_{11}$ to time $t_{15}$, which is identical to period $t_y$. By this means, all the reverse-charged toner that moved from the charging roller 7 to the photosensitive body 6 can pass the contact point 6*e* and be sent to the transfer point 6f without adhering to the photosensitive body 6.

The control circuit 41 also imparts a charge of −1,000 [V] to the transfer roller 4 for a period from time $t_5$ to time $t_8$, which is identical to period $t_y$. By this means, all the reverse-charged toner adhering to the photosensitive body 6 is moved to the carrier belt 9 at the transfer point 6*f*. Since the carrier belt 9 is moving in the direction E, the reverse-charged toner that adhered to the surface 9*a* of the carrier belt 9 is transported to the printing mechanism $P_2$.

As described above, the reverse-charged toner that adhered to the photosensitive body 6 in the printing mechanism $P_1$ is temporarily captured by the cleaning roller 101 until the transferring process is completed, and when the transferring process has been completed the reverse-charged toner is once more returned to the photosensitive body 6 and transported by the carrier belt 9. The operations up to the moving of this reverse-charged toner to carrier belt 9 are carried out in a similar manner to those in the printing mechanisms $P_2$, $P_3$ and $P_4$. Note that during the period in which that portion of the carrier belt 9 to which the reverse-charged toner has adhered is passing the printing mechanisms $P_1$, $P_2$, $P_3$ and $P_4$, a voltage of −1,000 [V] is applied to each of the transfer rollers 4, and a charge off −750 [V] is imparted to the photosensitive bodies 6 (the state shown in FIG. 13D), with the result that the electrical fields between the respective photosensitive bodies 6 and the transfer rollers 4 are oriented in the direction from the photosensitive body 6 to the transfer roller 4. Thus the reverse-charged toner that has adhered to the carrier belt 9 passes the transfer point 6*f* without once more moving to the photosensitive body 6, and is carried to the cleaning blade 13. The reverse-charged toner is then removed by means of the cleaning blade 13 and collected in the waste toner tank 14.

The printing operation of the printing mechanisms $P_2$, $P_3$ and $P_4$ is similar to that of the printing mechanism $P_1$, and its explanation is accordingly omitted.

Subsequently, the sheet of recording medium 27 onto which the toner images of the several colors have been successively transferred is transported to the fixing unit 35 and, after end of fixing, is ejected to the ejection stacker 39, thereby completing the printing operation, but this operation is similar to that of the first embodiment, and its explanation is accordingly omitted.

The operation of printing a single sheet of recording medium 27 is carried out in the manner described above. The printing of the second and subsequent sheets is carried out by repeating the printing operation described above.

In the third embodiment, the cleaning roller 101 is provided in contact with each of the photosensitive bodies 6 of the printing mechanisms $P_1$ through $P_4$, and by switching the polarity of the voltage applied to the cleaning roller 101, the reverse-charged toner adhering to the photosensitive body 6 is captured in the course of the printing operation, whereas at times other than during the printing operation, this captured reverse-charged toner is transported via the photosensitive body 6 to the carrier belt 9, with the result that the reverse-charged toner does not adhere to the charging roller 7. It is accordingly possible to prevent fouling of the photosensitive body 6 due to the adherence of the reverse-charged toner to the charging roller 7 and the reduction in the charge voltage on the photosensitive body 6. As a result, it is possible to secure high print quality over a longer period of time.

In the third embodiment, a voltage of negative polarity is applied to the transfer roller 4 for a period $t_y$ after the transferring process, but if, in a manner similar to that of the first embodiment, a voltage of −100 [V] is applied to the transfer roller 4 in the interval of printing of each sheet of recording medium 27, the amount of reverse-charged toner within the developing unit 8 can be further reduced.

Note also that whereas, in the third embodiment, the cleaning roller 101 is used, it is not thus limited, and may, provided it is in contact with the photosensitive body 6, also be, for example, a cleaning belt or the like.

In the second and third embodiments, it is also possible, as explained in the first embodiment, to remove reverse-charged toner adhering to the carrier belt 9 from the previous printing operation after the warming up of heat roller 36 of the fixing unit 35.

And whereas, in the second and third embodiments, the charging roller 7 is used, it is not thus limited, and may, provided it is in contact with and capable of imparting a charge to the photosensitive body 6, also be, for example, a belt-type charging mechanism.

In the second and third embodiments, the electrical field at contact point **6*e* in the time period during which the reverse-charged toner that adhered to the charging roller 7 and the cleaning roller 101 is being transported to the photosensitive body 6 and the carrier belt 9 is oriented in the direction from the developing roller 8*a* to the photosensitive body 6. It is accordingly possible to transport the reverse-charged toner adhering to the surface of developing roller 8*a* to the photosensitive body 6 and the carrier belt 9** in a manner similar to that of the first embodiment.

In the above described embodiments, the period of time required up to the end of transfer is measured by the control circuit 41 by means of the photointerrupter 60 detecting the leading edge of the recording medium 27 at time $t_1$, but it is also possible to measure the period of time required up to the end of transfer by detecting time $t_2$ at which the trailing edge of recording medium 27 passes the photointerrupter 60. It is further possible, instead of providing the photo interrupter 60, to measure the period of time required to the beginning of light emission by the LED head 3 or the periods of time to the beginning and end of transfer based on the starting of motor 54. In this way it is possible to omit the photointerrupter 60.

In the above described embodiments, the charger 32 is provided to charge the recording medium 27 and thereby cause the electrostatic adhesion of the recording medium 27 to the carrier belt 9, but since both the photosensitive body 6 and the transfer roller 4 are in contact with the carrier belt 9, it is also possible, provided the surface resistance of the carrier belt 9 is selected appropriately, to impart a charge to the recording medium 27 by the voltage difference between the photosensitive body 6 and the transfer roller 4, instead of providing the charger 52.

In the above described embodiments, the example described is one in which the photosensitive body 6 is in the form of a drum, but it may also be in the form of a belt. Also, the light emitting unit used in the above described embodiments is LED head 3, but it is also possible to use a laser beam head or the head using a liquid-crystal shutter.

In the above described embodiments, the example described is one in which the electrophotographic recording apparatus 1 or 100 has four printing mechanisms $P_1$ through $P_4$ disposed in parallel, but it is also possible to use a monochrome electrophotographic recording apparatus comprising a single printing mechanism. In this case the length of the carrier belt is shortened to correspond to the distance that the recording medium 27 is transported.

In the above described embodiments, reverse-charged toner adhering to the carrier belt 9 is removed by means of the cleaning blade 13 and collected in the waste toner tank 14, but it is also possible to cause a cleaning means comprising, For example, a sticky adhesive sheet, to into contact with the carrier belt 9, thereby attracting the reverse-charged toner and dirt and removing them from the carrier belt 9. In this case there is no need to provide the waste toner tank 14.

What is claimed is:

1. An electrophotographic recording apparatus which removes a reverse-charged toner that is mixed with a normal-charged toner, the reverse-charged toner having a polarity opposite to a polarity of the normal-charged toner, comprising:

a photosensitive body;

a charger for imparting a uniform charge to a surface of said photosensitive body;

a first power supply coupled to said charger and applying a voltage to said charger for the application of the uniform charge;

a writing unit located adjacent to said photosensitive body and forming an electrostatic latent image on the uniformly charged surface of said photosensitive body;

a developing unit located adjacent to said photosensitive body and causing a mixture of the normal-charged toner and the reverse-charged toner to adhere to a portion of the surface of said photosensitive body bearing the electrostatic latent image;

a carrier belt that transports a recording medium to and from said photosensitive body;

a transfer unit located in a region of said carrier belt and causing the toner adhering to the surface of said photosensitive body to transfer toward said carrier belt;

a second power supply coupled to said transfer unit and selectively applying to said transfer unit a first voltage, and a second voltage having a polarity opposite to a polarity of the first voltage;

a controller coupled to said second power supply and controlling an operation of said second power supply so that said second power supply applies the first voltage to said transfer unit during an image-forming stage, thereby causing the normal-charged toner adhering to the surface of said photosensitive body to be transferred to a recording medium on said carrier belt, and applies the second voltage to said transfer unit during a reverse-charged toner removing stage, thereby causing the reverse-charged toner adhering to the surface of said photosensitive body to be, transferred to said carrier belt; and a carrier belt cleaner located adjacent to said carrier belt, and removing the reverse-charged toner located thereon.

2. The electrophotographic recording apparatus of claim 1, wherein the normal-charged toner has a negative polarity, the reverse-charged toner has a positive polarity, the first voltage is positive, and the second voltage is negative.

3. The electrophotographic recording apparatus of claim 1, wherein the first voltage is applied to said transfer unit before or after the second voltage is applied to said transfer unit.

4. The electrophotographic recording apparatus of claim 1, further comprising a sensor coupled to said controller, said sensor detecting a passing of the recording medium past a predetermined position, and generating and outputting a detection signal to said controller, wherein said controller controls said second power supply on the basis of the detection signal.

5. The electrophotographic recording apparatus of claim 1, wherein said carrier belt is comprised of an endless and seamless plastic film.

6. The electrophotographic recording apparatus of claim 1, wherein said carrier belt has a surface resistance between $10^{10}$ ohms and $10^{14}$ ohms.

7. The electrophotographic recording apparatus of claim 1, wherein said transfer unit comprises a transfer roller in contact with said carrier belt.

8. The electrophotographic recording apparatus of claim 1, wherein said carrier belt cleaner comprises a cleaning blade, and a waste toner tank, said cleaning blade having a leading edge that is forced against said carrier belt, thereby removing the reverse-charged toner located thereon and causing the reverse-charged toner to fall into said waste toner tank.

9. The electrophotographic recording apparatus of claim 1, wherein the voltage applied by said first power supply to said charger comprises a third voltage, said first power supply additionally applying a fourth voltage, of opposite polarity to the third voltage, to a charger and causing any reverse-charged toner adhering to a surface of said charger to be transferred to the surface of said photosensitive body.

10. The electrophotographic recording apparatus of claim 9, wherein the normal-charged toner has a negative polarity, the reverse-charged toner has a positive polarity, the third voltage is negative, and the fourth voltage is positive.

11. The electrophotographic recording apparatus of claim 9, wherein said developing unit comprises a developing tank that contains the toner, and a developing roller in communication with said developing tank and supplying the toner from said developing tank to the surface of said photosensitive body;

said electrophotographic recording apparatus further comprising a third power supply coupled to said developing roller and applying a fifth voltage to said developing roller that causes any normal-charged toner adhering to a surface of said developing roller to be transferred to the surface of said photosensitive body, and applying a sixth voltage to said developing roller, having a polarity opposite to the fifth voltage, for preventing the reverse-charged toner adhering to the surface of said photosensitive body from being transferred to said developing roller.

12. The electrophotographic recording apparatus of claim 11, wherein the normal-charged toner has a negative polarity, the reverse-charged toner has a positive polarity, the fifth voltage is negative, and the sixth voltage is positive.

13. The electrophotographic recording apparatus of claim 1, further comprising:

a cleaning roller located adjacent to said photosensitive body and temporarily capturing the reverse-charged toner adhering to the surface of said photosensitive body; and a third power supply coupled to said cleaning roller and applying to said cleaning roller a third voltage that causes the reverse-charged toner adhering to the surface of said photosensitive body to be transferred to a surface of said cleaning roller, and applying to said cleaning roller a fourth voltage, of opposite polarity to the third voltage, that causes the reverse-charged toner adhering to the surface of said cleaning roller to be transferred to the surface of said photosensitive body.

14. The electrophotographic recording apparatus of claim 13, wherein the reverse-charged toner has a positive polarity, the third voltage is negative, and the fourth voltage is positive.

15. The electrophotographic recording apparatus of claim 13, wherein said developing unit comprises a developing tank that contains the toner, and a developing roller in communication with said developing tank and supplying the toner from said developing tank to the surface of said photosensitive body;

said electrophotographic recording apparatus further comprising a fourth power supply coupled to said developing roller and applying a fifth voltage to said developing roller that causes any normal-charged toner adhering to a surface of said developing roller to be transferred to the surface of said photosensitive body, and applying a sixth voltage to said developing roller, of opposite polarity to the fifth voltage, for preventing the reverse-charged toner adhering to the surface of said photosensitive body from being transferred to said developing roller.

16. The electrophotographic recording apparatus of claim 15, wherein the normal-charged toner has a negative polarity, the reverse-charged toner has a positive polarity, the fifth voltage is negative, and the sixth voltage is positive.

17. The electrophotographic recording apparatus of claim 1, wherein said developing unit comprises a developing tank that contains the toner, and a developing roller in communication with said developing tank and supplying the toner from said developing tank to the surface of said photosensitive body;

said electrophotographic recording apparatus further comprising a third power supply coupled to said developing roller and applying a third voltage to said developing roller, and wherein said controller is coupled to said third power supply and controls an operation of said third power supply so that said third power supply applies the third voltage to said developing roller during a first stage to cause normal-charged toner adhering to a surface of said developing roller to be transferred to the electrostatic latent image on the surface of said photosensitive body, and during a second stage to cause reverse-charged toner adhering to the surface of said developing roller to be transferred to the surface of said photosensitive body.

18. An electrophotographic color-image recording apparatus which removes a reverse-charged toner that is mixed with a normal-charged toner, the reverse-charged toner having a polarity opposite to a polarity of the normal-charged toner, comprising:

a plurality of image-forming sections for applying different colors;

a carrier belt for transporting a recording medium to and from said sections;

a carrier belt cleaner for removing any reverse-charged toner adhering to said carrier belt; and a controller that controls an operation of said apparatus;

each of said image-forming sections comprising:

a photosensitive body;

a charger for imparting a uniform charge to a surface of said photosensitive body;

a first power supply coupled to said charger and applying a voltage to said charger for the application of the uniform charge;

a writing unit located adjacent to said photosensitive body and forming an electrostatic latent image on the uniformly charged surface of said photosensitive body;

a developing unit located adjacent to said photosensitive body and causing a mixture of the normal-charged toner and the reverse-charged toner to adhere to a portion of the surface of said photosensitive body bearing the electrostatic latent image;

a transfer unit located in a region of said carrier belt and causing the toner adhering to the surface of said photosensitive body to transfer toward said carrier belt; and a second power supply coupled to said transfer unit and selectively applying to said transfer unit a first voltage, and a second voltage having a polarity opposite to a polarity of the first voltage;

wherein said controller is coupled to said second power supply and controls an operation thereof, so that said second power supply applies the first voltage to said transfer unit during an image-forming stage, thereby causing the normal-charged toner adhering to the surface of the photosensitive body to be transferred to a recording medium on said carrier belt, and applies the second voltage to said transfer unit during a reverse-charged toner removing stage, thereby causing the reverse-charged toner adhering to the surface of said photosensitive body to be transferred to said carrier belt for subsequent removal by said carrier belt cleaner.

19. The electrophotographic color-image recording apparatus of claim 18, wherein the normal-charged toner has a negative polarity, the reverse-charged toner has a positive polarity, the first voltage is positive, and one second voltage is negative.

20. The electrophotographic color-image recording apparatus of claim 18, wherein the first voltage is applied to said transfer unit before or after the second voltage is applied to said transfer unit.

21. The electrophotographic color-image recording apparatus of claim 18, further comprising a sensor coupled to said controller, said sensor detecting a passing of the recording medium past a predetermined positions, and generating and outputting a detection signal to said controller, wherein said controller controls said second power supply on the basis of the detection signal.

22. The electrophotographic color-image recording apparatus of claim 18, wherein said carrier belt is comprised of an endless and seamless plastic film.

23. The electrophotographic color-image recording apparatus of claim 18, wherein said carrier belt has a surface resistance between $10^{10}$ ohms and $10^{14}$ ohms.

24. The electrophotographic color-image recording apparatus of claim 18, wherein said transfer unit comprises a transfer roller in contact with said carrier belt.

25. The electrophotographic color-image recording apparatus of claim 18, wherein said carrier belt cleaner comprises a cleaning blade, and a waste toner tank, said cleaning blade having a leading edge that is forced against said carrier belt, thereby removing the reverse-charged toner located thereon and causing the reverse-charged toner to fall into said waste toner tank.

26. The electrophotographic color-image recording apparatus of claim 18, wherein the voltage applied by said first power supply to said charger comprises a third voltage, said first power supply additionally applying a fourth voltage to said charger, of opposite polarity to the third voltage, that causes any reverse-charged toner adhering to a surface of said charger to be transferred to the surface of said photosensitive body.

27. The electrophotographic color-image recording apparatus of claim 26, wherein the normal-charged toner has a negative polarity, the reverse-charged toner has a positive polarity, the third voltage is negative, and the fourth voltage is positive.

28. The electrophotographic color-image recording apparatus of claim 26, wherein each said developing unit comprises a developing tank that contains the toner, and a developing roller in communication with said developing tank and supplying the toner from said developing tank to the surface of said photosensitive body;

each of said image-forming sections further comprising a third power supply coupled to a respective developing roller and applying a fifth voltage to said developing roller that causes any normal-charged toner adhering to a surface of said developing roller to be transferred to the surface of said photosensitive body, and applying a sixth voltage to said developing roller, the sixth voltage having a polarity opposite to the fifth voltage, for preventing the reverse-charged toner adhering to the surface of said photosensitive body from being transferred to said developing roller.

29. The electrophotographic color-image recording apparatus of claim 28, wherein the normal-charged toner has a negative polarity, the reverse-charged toner has a positive polarity, the fifth voltage is negative, and the sixth voltage is positive.

30. The electrophotographic color-image recording apparatus of claim 18, wherein each of said image-forming sections further comprises:

a cleaning roller located adjacent to the respective photosensitive body and temporarily capturing the reverse-charged toner adhering to the surface of said photosensitive body; and a third power supply coupled to said cleaning roller and applying a third voltage to said cleaning roller that causes the reverse-charged toner adhering to the surface of said photosensitive body to be transferred to a surface of said cleaning roller, and applying to said cleaning roller a fourth voltage, of opposite polarity to the third voltage, that causes the reverse-charged toner adhering to the surface of said cleaning roller to be transferred to the surface of said photosensitive body.

31. The electrophotographic color-image recording apparatus of claim 30, wherein the reverse-charged toner has a positive polarity, the third voltage is negative, and the fourth voltage is positive.

32. The electrophotographic color-image recording apparatus of claim 30, wherein each said developing unit comprises a developing tank that contains the toner, and a developing roller in communication with said developing tank and supplying the toner from said developing tank to the surface of said photosensitive body;

each of said image-forming sections further comprising a fourth power supply coupled to a respective developing roller and applying a fifth voltage to said developing roller that causes any normal-charged toner adhering to a surface of said developing roller to be transferred to the surface of said photosensitive body, and applying to said developing roller a sixth voltage, of opposite polarity to the fifth voltage, for preventing the reverse-charged toner adhering to the surface of said photosensitive body from being transferred to said developing roller.

33. The electrophotographic color-image recording apparatus of claim 32, wherein the normal charged toner has a negative polarity, the reverse-charged toner has a positive polarity, the fifth voltage is negative, and the sixth voltage is positive.

34. The electrophotographic color-image recording apparatus of claim 18, wherein each respective developing unit comprises a developing tank that contains the toner, and a developing roller in communication with said developing tank and supplying the toner from said developing tank to the surface of said photosensitive body;

each of said image-forming sections further comprising a third power supply coupled to a respective developing roller and applying a third voltage to said developing roller; and wherein said controller is coupled to said third power supply and controls an operation of said third power supply so that said third power supply applies the third voltage to said developing roller during a first stage to cause normal-charged toner adhering to a surface of said developing roller to be transferred to the electrostatic latent image on the surface of said photosensitive body, and during a second stage to cause reverse-charged toner adhering to the surface of said developing roller to be transferred to the surface of said photosensitive body.

* * * * *